US006873256B2

(12) United States Patent
Lemelson et al.

(10) Patent No.: US 6,873,256 B2
(45) Date of Patent: Mar. 29, 2005

(54) INTELLIGENT BUILDING ALARM

(76) Inventors: Jerome H. Lemelson, deceased, late of Incline Village, NV (US); by Dorothy Lemelson, legal representative, P.M.B. 284, Unit 802, 930 Tahoe Blvd., Incline Village, NV (US) 89451; Robert D. Pedersen, 7808 Gleneagle, Dallas, TX (US) 75248

( * ) Notice: Subject to any disclaimer, the term of this patent is extended or adjusted under 35 U.S.C. 154(b) by 33 days.

(21) Appl. No.: 10/177,577

(22) Filed: Jun. 21, 2002

(65) Prior Publication Data

US 2003/0234725 A1 Dec. 25, 2003

(51) Int. Cl.[7] ..... G08B 1/08

(52) U.S. Cl. ..... 340/539.1; 340/511; 340/521; 340/522; 340/538.16

(58) Field of Search ..... 340/539.1, 628, 340/632, 286.05, 286.11, 326, 331, 511, 521, 522, 539.14, 539.16; 362/227; 345/8

(56) References Cited

U.S. PATENT DOCUMENTS

| | | | | |
|---|---|---|---|---|
| 3,634,846 A | | 1/1972 | Fogiel | 340/274 |
| 3,686,434 A | | 8/1972 | Lemelson | |
| 3,925,763 A | * | 12/1975 | Wedhwani et al. | 340/164 R |
| 4,023,146 A | * | 5/1977 | Carroll | 710/113 |
| 4,074,225 A | | 2/1978 | Vandeweghe | 340/237 |
| 4,161,750 A | | 7/1979 | Kamin | 358/105 |
| 4,198,653 A | | 4/1980 | Kamin | 358/105 |
| 4,257,063 A | | 3/1981 | Loughry et al. | 358/108 |
| 4,458,266 A | | 7/1984 | Mahoney | 358/105 |
| 4,462,022 A | | 7/1984 | Stolarczyk | 340/506 |
| 4,511,886 A | | 4/1985 | Rodriguez | 340/534 |
| 4,521,645 A | | 6/1985 | Carroll | 179/5 R |
| 4,531,114 A | | 7/1985 | Topol et al. | 340/539 |
| 4,581,606 A | | 4/1986 | Mallory | 340/539 |
| 4,614,968 A | | 9/1986 | Rattman et al. | 358/93 |
| 4,642,612 A | | 2/1987 | Crump | 340/541 |
| 4,679,077 A | | 7/1987 | Yuasa et al. | 358/108 |
| 4,737,847 A | | 4/1988 | Araki et al. | 358/108 |
| 4,754,266 A | | 6/1988 | Shand et al. | 340/691 |
| 4,772,876 A | | 9/1988 | Laud | 340/539 |
| 4,775,853 A | | 10/1988 | Perez Borruat | 340/521 |
| 4,796,018 A | * | 1/1989 | Nakanishi et al. | 340/691 |

(Continued)

FOREIGN PATENT DOCUMENTS

| | | | |
|---|---|---|---|
| DE | 0356734 A2 | 3/1990 | 13/18 |
| DE | 0445334 A1 | 9/1991 | 13/196 |
| DK | 2951544 A1 | 7/1981 | |
| GB | 2257598 A | 1/1993 | |
| GB | 2269454 A | 2/1994 | 17/12 |
| JP | 90/06567 | 6/1990 | |
| JP | 90/09012 | 8/1990 | |
| JP | 3225600 | 4/1991 | |

OTHER PUBLICATIONS

Find Vibration Sensors quickly using GlobalSpec's Product Finder "Vibration Sensors;" http://designinfo.com/Learn-More?comp=109; Sep. 23, 2001.

(Continued)

*Primary Examiner*—Daniel J. Wu
*Assistant Examiner*—Phung Nguyen
(74) *Attorney, Agent, or Firm*—Douglas W. Rudy

(57) ABSTRACT

System and method for detecting, monitoring and evaluating hazardous situations in a structure includes the use of an expert system and, to the extent necessary, fuzzy logic in the generation of solution sets. Sensor units having two-way communication capability are strategically located in a structure or in a matrix of structures. These units are high-level multifunctional detectors, RF and other wireless or hardwired communication modules and signal generating systems that may communicate with a base station, with other modules and/or may have onboard logical solution generation capacity.

30 Claims, 15 Drawing Sheets

U.S. PATENT DOCUMENTS

| | | | | | |
|---|---|---|---|---|---|
| 4,807,027 | A | | 2/1989 | Muto | 358/108 |
| 4,970,589 | A | * | 11/1990 | Hanson et al. | 358/108 |
| 4,996,521 | A | | 2/1991 | Hollow | 340/691 |
| 5,067,012 | A | | 11/1991 | Lemelson | 358/93 |
| 5,091,780 | A | | 2/1992 | Pomerleau | 358/108 |
| 5,166,664 | A | | 11/1992 | Fish | 340/539 |
| 5,182,541 | A | | 1/1993 | Bajorek et al. | 340/428 |
| 5,202,661 | A | | 4/1993 | Everett, Jr. et al. | 340/522 |
| 5,227,776 | A | | 7/1993 | Starefoss | 340/825.36 |
| 5,267,180 | A | | 11/1993 | Okayama | 364/571.03 |
| 5,281,951 | A | | 1/1994 | Okayama | 340/511 |
| 5,283,644 | A | | 2/1994 | Maeno | 348/152 |
| 5,319,698 | A | | 6/1994 | Glidewell et al. | 379/39 |
| 5,382,943 | A | | 1/1995 | Tanaka | 340/539 |
| 5,394,139 | A | | 2/1995 | Dards | 340/541 |
| 5,400,011 | A | | 3/1995 | Sutton | 340/566 |
| 5,412,738 | A | | 5/1995 | Brunelli et al. | 382/115 |
| 5,467,402 | A | | 11/1995 | Okuyama et al. | 382/104 |
| 5,471,239 | A | | 11/1995 | Hill et al. | 348/155 |
| 5,546,072 | A | | 8/1996 | Creuseremee | 340/574 |
| 5,650,770 | A | | 7/1997 | Schlager et al. | 340/573 |
| 5,654,690 | A | * | 8/1997 | Ishikawa et al. | 340/506 |
| 5,666,157 | A | | 9/1997 | Aviv | 348/152 |
| 5,678,205 | A | * | 10/1997 | Gray | 455/90 |
| 5,726,633 | A | * | 3/1998 | Wiemeyer | 340/587 |
| 5,764,217 | A | * | 6/1998 | Borrel et al. | 345/156 |
| 5,775,016 | A | * | 7/1998 | Chien | 40/544 |
| 5,784,028 | A | * | 7/1998 | Corman et al. | 342/357.17 |
| 5,832,187 | A | * | 11/1998 | Pedersen et al. | 706/45 |
| 6,124,795 | A | * | 9/2000 | Bernau et al. | 340/628 |
| 6,208,247 | B1 | * | 3/2001 | Agre et al. | 340/539 |
| 6,249,221 | B1 | * | 6/2001 | Reed | 340/539 |
| 6,415,646 | B1 | * | 7/2002 | Kessel et al. | 73/23.2 |
| 6,420,973 | B2 | * | 7/2002 | Acevedo | 340/628 |

OTHER PUBLICATIONS

Find Flame Detectors quickly using GlobalSpec's Product Finder "Flame Detectors;" http://designinfo.com/LearnMore?comp=255; Sep. 23, 2001.

Smoke Detectors on GlobalSpec; "Search Form HelpSmoke Detectors," htpp://designinfo.com/help/SmokeDetectors.html, Sep. 23, 2001.

Find Smoke Detectors quickly using GlobalSpec's Product Finder; "Smoke Detectors," http://designinfo.com/LearnMore?comp=210; Sep. 23, 2001.

Desmarais, Ron and Breuer, Jim; "How to Select and Use the Right Temperature Sensor," http://main.WebContent.gs_main . . . ag.com/articles/0101/24/main; Sep. 23, 2001.

GlobalSpec.com–IndustrialScientific; "Review of Senor Technologies Used in Personal Safety Instruments;" Sep. 23, 2001; http://designinfo.com/industrialscientific/ref/IndustrialScientific.html.

Find Vibration Sensors quickly using GlobalSpec's Product Finder "Vibration Sensors;" http://designinfo.com/LearnMore?comp=109; Sep. 23, 2001.

Find Measurement Microphones qucikly using GlobalSpec's Product Finder; "Measurement Microphones," http://designinfo.com/LearnMore?comp=276, Sep. 23, 2001.

Control Instruments Corporation; "Electrochemical Sensors for Toxic Gas;" http://www.controlinstruments.com/products/echem.html; Sep. 23, 2001.

Smoke Senors; "Air–Conditioning System Operation Principle of Smoke Sensor," http://www.denso.co.jp/CARPARTS/english/product/juncho/air/00.html; Sep. 23, 2001.

General Information for TGS Sensors.

Strand, Carl; "Seismic Monitoring and Actuation;" http://www.strandearthquake.com/sma.html; May 28, 2001.

Figaro Product Information; TGS 4160–for the detection of Carbon Dioxide.

* cited by examiner

220 temperature = low

| CO \ smoke | low | medium | high |
|---|---|---|---|
| low | low | medium | high |
| medium | medium | medium | high |
| high | high | high | high |

222 temperature = medium

| CO \ smoke | low | medium | high |
|---|---|---|---|
| low | medium | medium | high |
| medium | medium | medium | high |
| high | high | high | high |

224 temperature = high

| CO \ smoke | low | medium | high |
|---|---|---|---|
| low | high | high | high |
| medium | high | high | high |
| high | high | high | high |

Fig. 10

INTELLIGENT BUILDING ALARM

BACKGROUND OF THE INVENTION

This invention relates to an intelligent alarm system for detecting hazardous situations in a building, informing building occupants of optimal escape routes or survival strategies and assisting emergency personnel in rescuing people inside the building. Building hazards, including fire, earthquakes, intruders, etc., have the potential for large numbers of casualties. Effective building alarm systems must have the capability to process a plurality of input types to determine the nature of the situation involving danger to persons in the building. The building alarm system must also have more than simple audio/visual outputs for helping people in the building find safe escape routes.

Use of the term building in this invention refers to any structure including, but not limited to, office buildings, commercial buildings, factory/warehouses, residential homes, etc. Aspects of building alarm systems are described in, U.S. Pat. Nos. 3,686,434; 4,511,886; 3,634,846; 4,614,968; 4,775,853; 5,267,180; 5,281,951, each of which is incorporated herein by reference.

Detection of hazards that may exist in a building is crucial in the proper functioning of an intelligent building alarm system. Current sensor technology allows for the accurate monitoring of many building parameters including, but not limited to, carbon monoxide (CO), hydrocarbons, temperature, vibration, etc. Accurate sensor readings using sophisticated sensor technology can minimize the occurrence of costly false alarms.

"Expert systems" are becoming more extensively used as a problem solving tool. An intelligent building alarm can benefit from the use of expert system concepts. Many different possibilities for hazards, and dealing with them, must be analyzed to adequately alert persons in a building of dangerous situations. Expert systems are designed to make use of pooled knowledge resources from a group of experienced persons having with considerable experience in diverse fields relating to emergency situations including, but not limited to, fire fighting, toxic fume detection, earthquake physics, human tolerance to hazards, medical problems, etc.

"Fuzzy logic" is a logic system that is a superset of Boolean logic. Since the world is primarily analog in nature, many situations cannot be adequately modeled using simple Boolean true/not true logic. Simply concluding that an event, element, or condition is either "X" or is not "X" is seldom adequate in making a complex decision. For example, the temperature in one room of a building during a fire in the building cannot simply be distinguished as a danger or not a danger. Other factors, such as gas concentration, smoke occurrence and density, flames, etc., also limit an analysis of possible danger when simply considered as, for instance, high danger or not high danger. Fuzzy logic helps model problems involving humanistic issues by allowing membership in more than one set and allowing a membership transition band from one set to another set.

A preferred alarm system will have the capability of transferring and processing data from one, more than one or many input devices. Current information networking technology provides for low cost and standardized hardware and software systems with the performance capacity to handle many input and/or output connections. A wire or cable based communications system will be used to facilitate communications within a single building or, also a possibility, within a cluster of buildings. Alternatively, radio communications can be used for a building alarm system, avoiding a failure or miscommunication due to damage to cables in a hardwired alarm system.

SUMMARY OF THE INVENTION

The present invention provides for assisting people at risk, including emergency personnel, involved in dangerous situations such as those created by fires in buildings, earthquakes affecting a building, building collapse, toxic fumes in a building, presence of air borne bacteria in the heating, ventilation, and air conditioning system (HVAC), terrorist attacks, or any other dangers that may exist in a building, boat, plane, train, or other structure. Sensor units are located in a plurality of locations throughout a structure to provide adequate sensor input and output coverage for the structure. The sensor unit or plurality of sensor units are activated to sample a variety of environmental factors. The sensor output signals broadcast to a central point monitored by software and/or emergency personnel. Collected information includes; localized temperature, smoke levels in the structure, toxic gas levels, critically significant sounds (including speech), optical information, location position of hazards and sensor units, and other types of useful information. Expert system software, running on a computing device or CPU, processes the source collected data to assist the emergency personnel in determining the best plan of action and implementation of the plan for the safety of persons in the building.

Sensor units are attached to walls, ceilings, cabinets, and other locations appropriate for sensor coverage of a particular area. The sensor unit is equipped with the necessary transducers to allow for the detection of temperature, smoke levels, toxic chemical levels, and the like in a particular area of a building. Some of the sensors will be common to all applications, but some will be application specific. For example, all applications will have a sensor for detecting temperature but some may contain transducers for the detection of gasoline or other combustible hydrocarbons at a refinery that would not be necessary at other buildings where these flammable gases are not present.

The sensor unit may also contain an analog or digital camera. The camera constantly monitors the vicinity of the camera for data useful to emergency personnel. Computer vision algorithms are employed to make determinations of the type of hazards existing in the camera's vicinity or help determine the presence or absence of people in view of the camera. A camera responding to other non-visible wavelengths of light, such as infrared, can help determine the type and location of flames, hot spots, people, etc.

The sensor unit may also contain a microphone for audio input. In some hazardous conditions, audio cues may be of great benefit for emergency personnel in determining the type and location of certain types of hazards. For example, if one or more people have taken control of the building through the use of firearms, the location of assailants can be determined through sounds and noises produced by the attackers. Multiple sensor units pick up a sound, possibly a gunshot, at different locations and can, through the use of signal processing algorithms, determine the location of the firearm.

A microphone may also "pickup" human speech to be processed by speech recognition algorithms. Speech recognition algorithms having a speaker independent capability, allow voices to be recognized without prior speech recognition input training. For a limited vocabulary system, a speaker independent speech recognition is realizable with currently available technology. Building residents and visitors can be trained on the speech recognition system, to obtain a working knowledge of the words known by the speech recognition component of the intelligent building alarm system in that building.

A sensor unit may have warning output capabilities as well as the previously described input sensing functions. A light may provide various selected colors for various selected situations and flashing functions to provide visual warnings to persons in the building. Specific colors may represent the danger level in the area surrounding the particular sensor unit. For example, if the light emits a green light, it may represent that the area is safe and if the light emitted is red, the area is unsafe and should be avoided because of dangers.

Another important possible warning output is an audio speaker. A speaker allows for emergency personnel to interact with persons in the building who may be confused or disoriented due to smoke, flames, injury, or other conditions. If persons are in an area where hazards exist, they can be warned by the emergency personnel using the speaker at a given sensor unit location. The audio speaker may also be used for simple emergency condition warning in much the same way as conventional fire alarms. Audio from the speaker in the sensor unit will be useful to a person who can't see due to smoke in the building. The sound emitted from the audio speaker can be used as a directional beacon in a visually challenging environment. The endangered person in the building can be directed through verbal commands from emergency personnel or simply follow a warning audio signal emitted from the speaker.

Information from the sensor unit must be delivered to a central base unit to be processed or monitored by emergency personnel. Commands from emergency personnel to control output of the sensor unit also must also be delivered to the sensor unit. Bi-directional communications are accomplished by two different means; hardwiring and radio broadcast. An antenna on the sensor unit provides for transmit and receive functions associated with the radio broadcast. Hardwired communications are accomplished through a cable and connector that is plugged into a socket. Redundant communications are contemplated in this invention due to the importance placed on this type of emergency information. Even if the building has been damaged and the hardwired communications have been disrupted, radio communications will still function.

Sensor units are equipped with Global Positioning System (GPS) receivers to identify the location of the sensor units. Position information is transmitted to the base unit with other information to be used both for verification of sensor unit placement and as input to emergency decision making algorithms implemented by the current invention. The sensor unit is initially placed in a specific location in the building but may be displaced due to a variety of factors including earthquakes, explosions, vandalism of the unit, etc. For example, if a building has been damaged due to an earthquake or explosion it is desirable to know how far the sensor unit may have moved from its original location. If the broadcast positions of the sensor unit before and after the damaging event differ by a substantial amount, emergency personnel have important information about the extent of damage to that portion of the building.

GPS positioning in the sensor units also allows for easy relocation of the sensor units. When a new facility is constructed, sensor units from the old building can be moved to the new building without having to notify the base unit of the new location of the sensor unit in the new building location. Recognition of the new sensor unit positions would automatically be accomplished when the sensor unit goes online and begins broadcasting its new position. This is a significant time saving feature for a facility containing many sensor units.

Another benefit resulting from the use of GPS associated with the sensor units is seen in the use of portable sensor units. Where a hazardous event requires evacuation of a building, a portable sensor unit is acquired from a known location providing information similar to the fixed units. A radio broadcast signal to the base unit provides constantly updated position information to the emergency personnel. Communications with the portable sensor unit allows the emergency personnel to direct the individual to safety.

The invention utilizes expert system algorithms to make decisions relating to danger assessment and provides help for emergency personnel in rescuing people inside a building experiencing a hazardous condition. Persons with detailed knowledge in areas related to emergency situations and human safety and tolerances to specific hazards provide input to a knowledge base for the expert system. Using this knowledge, intelligent decisions can be made relating to possible hazardous situations and the rescue of people in a building.

Many decision-making environments are not suited to a Boolean type of response. For example, is it dangerously hot at 125° F. but not dangerously hot at temperatures less than 125° F. Fuzzy logic allows for variables associated with danger assessment and rescue of persons to have a degree of membership in multiple sets, such as danger level being low, medium, or high. Using fuzzy logic enhances the ability of the current invention to assess many possibilities of exit from a facility experiencing dangerous conditions and place a relative value on each of them.

Many buildings experience reduced visibility for persons in them during some types of hazardous conditions. The current invention employs directional floor lighting and smart exit signs integrated into the overall system. The directional floor lighting provides a path for persons to follow that are in a building experiencing reduced visibility. The lights will sequence in the best direction for escape from a particular room. Exit signs will also provide directional information to persons in rooms that contain them. The directional floor lighting and smart exit signs provide assistance in stairways as well as level parts of the building. Sometimes a best escape route is upstairs to another floor or the roof.

The floor lighting system can also be used to lead rescue or service personnel to a target area. The target area could be a trapped person, an equipment location or a "safe zone" inside the building.

The present invention provides emergency personnel information about current conditions inside a building with a three-dimensional (3-D) display system. The 3-D display has a database of floor plan information for the buildings monitored by any implementation of the invention. The display shows a skeleton perspective of a building with the capability of selecting specific information from sensor units or output of the expert system algorithms. For example, fire-fighting crews want to know the location of flames in a burning building. This information is available from flame sensors or execution of flame recognition algorithms processing video signals from the cameras on the sensor units. Displaying the locations of flames assists the fire fighters in extinguishing the fire and determining the best escape routes for persons in the building.

The current invention utilizes a helmet mounted display and speaker for assisting emergency personnel in the rescue of trapped people or other emergency personnel. The helmet mounted display allows information about the building or current conditions in the building to be displayed on a screen located in close proximity to the eye of the emergency person outfitted with the system. Various audio and visual information can be sent to the unit via a radio transmission system. For example, a fireman can be sent information about the location of trapped persons in the building. A building layout with the best route to get to the trapped persons can also be displayed in the helmet mounted display helping direct the fireman to the people. The expert system can then provide information and a path for the best escape route.

The floor lighting system in combination with the helmet mounted display, could be one method of directing a rescue worker to the best route. The helmet mounted display provides critical support information to emergency personnel in the building in both high and low visibility conditions.

It is therefore an object of this invention to implement an intelligent building alarm using a plurality of sensor units connected to a central computer for monitoring the status and condition of a building.

It is another object of the invention to have transducers on the sensor units for constant monitoring of a buildings' status.

It is another object of the invention to have a camera on the sensor unit for input of video images for remote viewing or processing with computer vision algorithms and to provide for communication.

It is another object of the invention to have a microphone on the sensor unit for remote monitoring of audio information or processing with speech/sound recognition algorithms.

It is another object of the invention to have a speaker on the sensor unit to provide for voice or warning sounds to communicate with persons in the vicinity of the unit.

It is another object of the invention to have a light on the sensor unit to provide visual warning indicators to persons in the vicinity of the unit.

It is another object of the invention to provide sensor unit position information using the Global Positioning System (GPS) or other positioning scheme.

It is another object of the invention to employ an expert system for troubleshooting possible dangers that may exist in a building or find escape routes for persons in the building.

It is another object of the invention to implement fuzzy logic algorithms to assist in determining building status information or escape routes.

It is another object of the invention to provide standardized connections for power and hardwired communications.

It is another object of the invention to implement both hardwired and radio communications for redundancy.

It is another object of the invention to provide a battery backed up system, complete with a battery charger, providing direct current power for charging the battery.

It is another object of the invention to have all sensor units in a building or cluster of buildings communicate with a centralized base computer.

It is another object of the invention to implement communications with the base computer using well-established communications technologies for reliability and ease of implementation.

It is another object of the invention to provide a three-dimensional (3-D) display system for emergency personnel viewing of information about a current situation inside a structure or helping determine escape routes for a person in the facility or a rescue route for rescuers.

It is another object of the invention to provide floor lighting for help in directing persons out of a structure experiencing limited visibility.

It is another object of the invention to provide a portable sensor unit that is worn or carried by a person in the building experiencing a hazardous situation.

It is another object of the invention to provide a helmet having a helmet mounted display system to assist rescue and emergency personnel entering portions of a building experiencing a hazardous situation.

The preferred embodiment of the invention is described in the following Detailed Description of the Invention and attached Figures. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

The invention will be readily understood through a careful reading of the specification in cooperation with a perusal of the attached drawings wherein:

FIG. 10 shows possible inference rule tables for temperature, smoke levels, and CO levels;

DETAILED DESCRIPTION OF THE DRAWINGS

The present invention relates to collecting data about conditions inside a building that is experiencing a hazardous situation. Sensor units have the necessary transducers, and other data collecting devices for supplying information to emergency personnel in hazard determination and assisting any persons remaining in the building. This data is also transmitted to an expert system knowledge base for processing by the expert system. Visual tools and expert system outputs assist the building occupants and emergency personnel in ways previously unavailable to them, including best escape route determination. These and other features of the present invention will be described in the following section.

Figure 1:
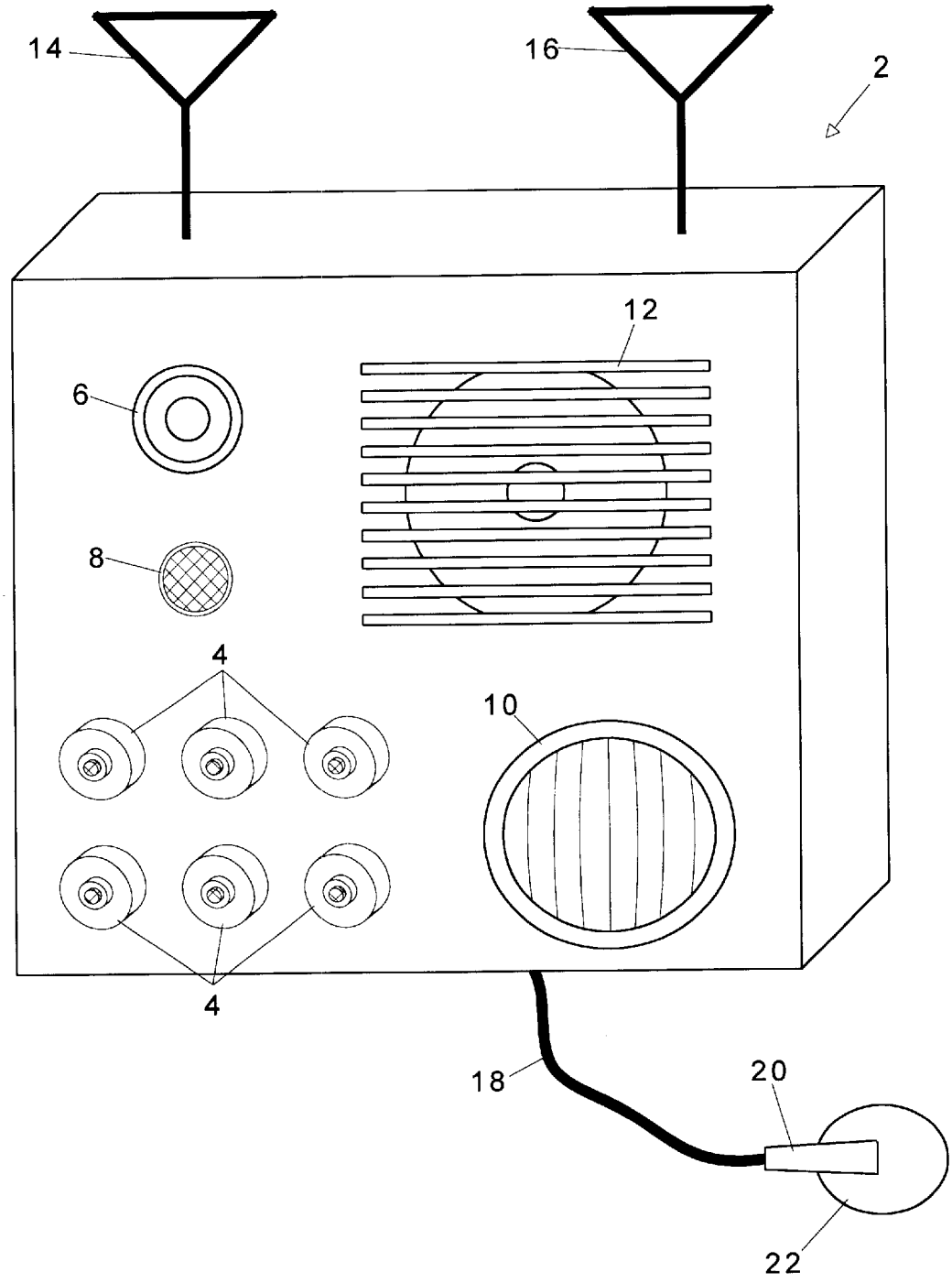
FIG. 1 demonstrates the layout of one possible sensor unit design.

FIG. 1 shows the layout of one possible sensor unit design generally 2. The sensor unit is equipped with transducers 4 for converting a variety of different hazards into electrical signals that can be processed by hardware and software associated with the system. Typical transducers in the unit sensor may include, but are not limited to: toxic gases, smoke, temperature, flame, vibration, etc. An expert system has predefined safe limits for readings on any of the transducers, warning the proper authorities when a limit is exceeded.

The sensor units also have a camera 6 onboard for acquiring video of the area proximate the sensor unit. Emergency personnel for danger assessment of that area can use video images in many ways including direct observation. Computer vision algorithms are also used to process the images for particular information, such as flame detection, motion detection, person detection, structural integrity, etc.

FIG. 1 also shows a light 10 for aiding persons inside the building. The light has many uses including simple lighting of an area that has lost power. The light can also be illuminated with different colors indicating danger levels in a particular area. For example, a green light can represent no danger, a yellow light represents some danger, and a red light represents a high danger.

The sensor unit in FIG. 1 also has a microphone 8 for audio input. Possible audio signals include speech, gunshots, flames, falling debris, etc. A person calling for help might not be seen by the camera 6 but may be heard over the audio input or gunshots might indicate terrorist activity in a particular portion of the building.

The speaker 12 in the sensor unit allows emergency personnel to get information to people in the building. An example would be to give instructions to a person on the best escape route from the building. Many hazardous situations might produce limited visibility due to unexpected events in the building, such as fire.

Radio communications to and from the unit requires an antenna. FIG. 1 demonstrates two antennae, one for data communications 14 and one for the onboard GPS receiver 16. A single antenna design incorporating both the data communications and GPS functions may also be employed.

Power and hardwired communications are accomplished through conduit 18 that is connected to a standardized plug 20 that is then connected to a standardized socket 22 in the wall. Standardized connections insure that sensor units will properly connect to the base unit without modifications. Newer models of sensor units may be produced with standardized connections, permitting simple direct replacements without any modifications to the backbone network. A battery integral with the sensor unit is used when power is lost from the wall socket connection 22. The battery is kept at full charge by a battery charging circuit whenever power is available from the wall connection 22.

Figure 2:
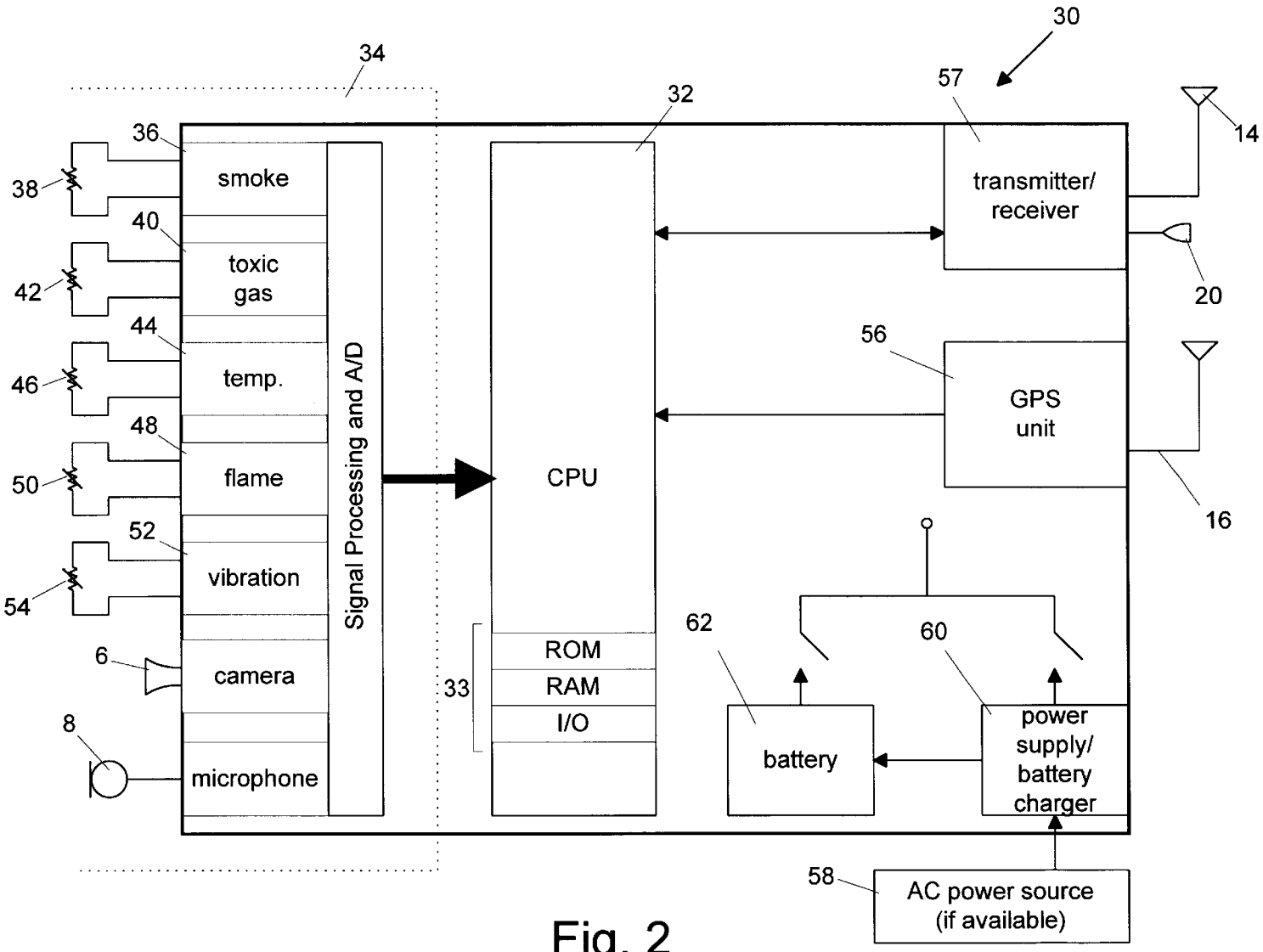
FIG. 2 is a block diagram of the sensor unit, shown in FIG. 1.

The functioning of the sensor unit 2 (FIG. 1) is more thoroughly described by the block diagram 30 of the unit shown in FIG. 2. The sensor unit is a hybrid (digital and analog) electronic system with a digital processing section and analog sections handling sensor inputs, communications, and the power supply. Using state-of-the-art integrated circuit design and manufacturing techniques, many of the digital and analog functions can be incorporated into a minimal number of integrated circuits (IC's), possibly even a single IC.

The digital functions of the sensor unit include one or more central processing units (CPU's) 32 that execute system and application level software. Multiple CPU's may be distributed for handling of separate functions such as communications and input from the sensors. Any CPU requires supporting hardware to function properly. A complete processing capability requires RAM, ROM, and input/output 33 support. The CPU 32 of FIG. 2 incorporates the necessary hardware into a single functional unit.

The input section 34 of the sensor unit 30 derives information from environmental conditions in the area around the unit. Different types of inputs include sensor (smoke, toxic gas, temperature, vibration, etc.), video inputs (visible, infrared, etc.), audio inputs, and any other type of input appropriate for a given facility. The input section performs the necessary signal processing of the input signals to prepare them for analog to digital (A/D) conversion. After the A/D conversion process, the digital data is placed in the system RAM allowing processing by the CPU. Movement of the data may be accomplished by notifying the CPU that the digital data is available or the input section 34 may have a dedicated CPU to handle operations of the input section. Processing of the input signals may occur before or after the A/D conversion. Digital signal processing (DSP) algorithms can perform all necessary conditioning of the inputs minimizing effects of harsh ambient electrical noise. The DSP algorithms may be executed by the main CPU 32 or by a processor dedicated to the input section 34.

Many emergency situations have the potential for smoke being a major hazard. Even a relatively small fire can produce large amounts of smoke depending on the material being consumed by the fire. This smoke can rapidly spread throughout a building limiting available escape routes. Smoke can restrict visibility when trying to find an escape route or can limit ones ability to escape the building due to detrimental effects of inhaled smoke.

The smoke sensor 36 has a transducer 38 that provides for converting the smoke intensity to an electrical signal that can be digitized and transmitted to the monitoring facility. There are two basic types of smoke detectors: the ionization type and the photoelectric type. The ionization type detector has a chamber with some form of ionizing material, typically the radioactive material Americium-241 (Am-241) is used. Alpha particles from the Am-241 strike oxygen and nitrogen atoms in the chamber ionizing them into negatively charged electrons and positively charged atoms. Metal plates with a voltage applied will attract the charged particles allowing a relatively constant current to exist in the detector circuitry. Smoke entering the ionizing chamber will interfere with this ionization process reducing the current in the circuit signaling an alarm when a predefined threshold of smoke density is crossed. Photoelectric smoke detectors employ a light source and detector at 90 degrees to the light source. Light from the source normally passes the detector due to the angle between them. When smoke enters the area, light is reflected off the particles and some hits the detector causing a current in the detection circuitry. An alarm is triggered when this current passes a threshold value.

A toxic gas sensor 40 uses some form of transducer 42 for monitoring of the concentrations of potentially danger gasses such as carbon monoxide (CO), hydrogen sulfide ($H_2S$), natural gas or any other gas that is harmful to humans. Danger to humans can exist as a direct health threat from inhaling the toxic gas, or an indirect threat such as the possibility of explosion due to high concentrations of flammable gasses.

Gas detection employs many different techniques including: catalytic sensors, thermal conductivity sensors, non-dispersive infrared (NDIR) sensors, metal oxide sensors (MOS), electrochemical sensors, fiber optic sensors, and photo ionization detectors (PID). Each of these technologies have their own levels of precision and types of gas they can detect. Limitations of the various technologies, including consumption of large amounts of power (poor battery usage) and poor response with other contaminants in the environment, requires careful planning in choosing sensor types to best benefit a given application.

High temperatures resulting from a fire can make many portions of a building unusable for escape routes. Therefore, careful monitoring of temperature is accomplished by a temperature sensor 44 using one of several types of transducers 46. Temperature, like some toxic gasses, is invisible and might not be known as a serious threat until people or emergency personnel enter an area with temperatures above acceptable human limits.

Temperature sensors come in four basic varieties: resistance temperature detectors (RTD), integrated circuit (IC) sensors, thermistors, and thermocouples. RTD's use a metal sensing unit that has very precise, linear resistance vs. temperature characteristics. Typically expensive materials such as platinum are used to obtain these precise characteristics. RTD's must have supporting circuitry to process the electrical signal generated in the sensor. IC temperature sensors use semiconductor materials for the variable resistance properties. The temperature sensing function is typically integrated with other digital functions in a single device. Thermistors use semiconductor materials for resistance variations but do not have the linearity of the RTD, yet are much less expensive. Like the RTD, thermistors require support circuitry for processing the electrical signal generated in response to a temperature change.

A flame detection sensor 48 with transducer 50 allows emergency personnel to determine the exact locations of flames in the building. Knowing the location of flames can help emergency personnel to direct persons in the building to avoid areas with extreme danger associated with flames. Information concerning location of flames in a building can help direct efforts to extinguish the flames.

Flames can be detected by the energy they radiate, such as ultra-violet (UV), infra-red (IR), and visible. Thirty to forty percent of a flame's radiated energy exists as electromagnetic energy. Flame detectors typically are optical sensors monitoring specific bands of electromagnetic radiation. The monitored wavelengths provide input to flame detection algorithms that can vary significantly in complexity.

The camera 6 may also be used for flame detection. The digitized image can be processed with computer vision algorithms specifically designed to detect flames.

The sensor unit may also have a vibration sensor 52 with transducer 54 to assist in detecting motion of the building. The vibration sensor is very useful for buildings in areas of higher seismic activity. Also, if parts of a building are substantially damaged from a hazardous event the vibration sensor can help determine the stability of the damaged section.

Vibration sensors are primarily implemented with 3 types of transducers: acceleration, linear velocity, and proximity/displacement. A vibration sensor specifically designed for monitoring seismic activity is known as a seismometer. Each of the transducer types have different characteristics and must be chosen carefully for each application.

Use of a camera 6 in the current invention allows for the detection of many different types of information related to hazardous situations that may exist in a structure or building. Visual information from the different sensor units can provide critical information about current conditions, people present, possible escape routes, etc. for the area around a sensor unit. Video from the camera is digitized for transmission to the base unit for direct viewing by emergency personnel or can be processed by computer vision algorithms for various types of information. With a large facility, direct viewing images from all sensor units would be very time consuming but constant computer processing of those images provides critical information about current conditions.

A microphone 8 in the sensor unit 30 provides audio input that can provide information not available from the other forms of input. Audio from the area around a sensor unit is digitized and processed by algorithms looking for specific types of information. Speech recognition algorithms can recognize calls for help in an area where a person is not visible to the camera 6. Other audio recognition algorithms can recognized such things as gunshots, flames, building integrity, etc.

A GPS receiver 56 is also implemented, as seen in FIG. 2, for obtaining position information. The GPS receiver 56 is constantly receiving position information from multiple satellites allowing for constant updating of the sensor unit position. Current position of the sensor is collected by the CPU 32 to be transmitted to the base unit. Proper functioning of the GPS receivers requires an antenna 16 for reception of broadcast position signals from the satellites. Careful design of the antenna 16 ensures adequate signal reception for a variety of locations the GPS receivers.

Data collected by the CPU is transmitted to the base computer for processing. Communications are performed by the transmitter/receiver section 57 and/or the hardwired connection 20. The current invention may use both hardwired and radio communications for redundancy. The hardwired communication is performed using the standardized connector 20 and cabling within the building, and the radio communication is performed using the antenna 14.

Communication hardware and protocols are implemented by any method available for servicing a plurality of nodes in a communication system. One system in wide use today that is capable of serving many hardwire nodes is the Ethernet standard. High density code division multiple access (CDMA) systems such as used by current cellular phone systems is an example of a radio communication system capable of handling the high numbers of sensor units that may be required in a larger facility or handled by a single base unit. The current performance of Ethernet or CDMA are sufficient to operate many sensor units connected to a base unit, but other communication system designs are possible.

Power to the sensor unit must be maintained at all times. Under normal operating conditions, the sensor unit is connected to an alternating current (AC) source 58 of electrical power. The AC power is converted to direct current (DC) in a power supply 60 for use by the onboard electronics. The power supply 60 also maintains peak charge on a battery 62 for use if the AC supply is lost due to hazardous conditions or an AC outage to the building. Data from individual sensor units is transmitted to a central computer for processing. The base computer has predetermined levels for acceptable conditions being indicated by the sensor units. For instance, if a smoke sensor transmits a signal to the base computer that smoke levels in the building are beyond the predetermined safe level, a warning is issued to the building inhabitants and the proper emergency personnel. The base computer system may be located in each building, a centralized location for an area, or even incorporated with the existing "911 emergency system." The base computer could also have separate communication links to the appropriate emergency agencies, such as fire department, police department, etc.

The base computer implements expert system algorithms to determine the type and intensity of the hazardous situation. Inputs from the sensor units provide information to the knowledge base used in the decision making process. The plurality of sensor types provide a broad range of input to the knowledge base allowing many conclusions to be made about the status of a given situation. For example, if a vibration sensor indicates that a large seismic event took place and temperature or smoke sensors indicate a fire is present, then emergency personnel are notified to prepare for both fire and earthquake damage. The use of many sensor types also allows for error checking of the sensor unit. For example, a flame sensor may have delivered a signal to the base unit indicating a fire but visual inspection of the camera video signal may show that in actuality, no fire exists. Checks of other sensor units and video signals may be used to verify that no danger exists. The malfunctioning sensor unit may then be scheduled for repair.

Figure 3:
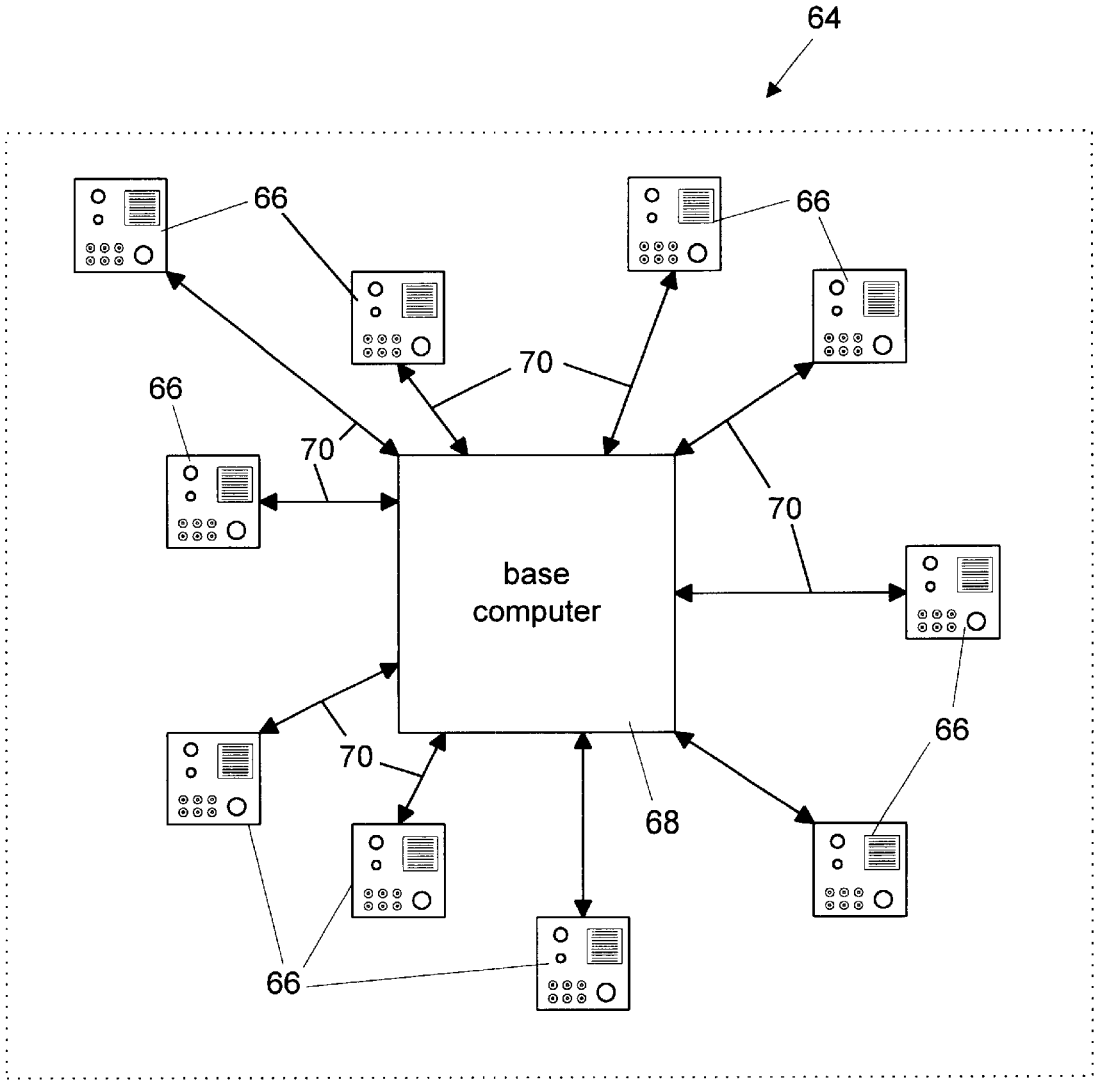
FIG. 3 is a block diagram of a single building with a base computer.

Sensors are located at a sufficient number of locations in a building to provide adequate hazard detection and emergency assistance for persons in the building. They must all communicate with the base computer to allow updating of the knowledge base for proper operation of the expert system algorithms. FIG. 3 demonstrates one possible system configuration where the base computer is located in the building with the sensor units. In FIG. 3 the building generally 64, has multiple sensor units, such as each individual, identical unit, 66 located in a plurality of locations throughout the structure or facility. The sensor units 66 are connected to the base computer 68 through communication links, such as similar links each shown as 70. The communication links are comprised of established technologies using appropriate communication media such as, but not limited to, wire, fiber-optic, radio broadcast, etc. The communication links 70 of FIG. 3 are shown in a point-to-point network topology but could be implemented in a variety of other network topologies such as, but not limited to, multi-drop (Ethernet), token ring, etc. If the communication links 70 are implemented using radio broadcast, established signal processing techniques such as, but not limited to, digital spread spectrum (DSS) can be used for discriminating the multitude of broadcasts from each of the sensor units. Code division multiple access (CDMA) is a DSS technique currently used in cellular phone technology that, as well as other DSS techniques, may have utility in implementing radio broadcast communication links between sensor units and the base computer for this invention.

A building under construction may implement some form of dedicated network for the current invention or integrate communications into other network hardware installed for standard types of networking functions. To upgrade existing structures with the current invention several techniques could be used. Integrating the sensor units into an existing network would minimize the initial cost of the communication links 70 between the sensor units and base computer. Radio broadcast eliminates the need for any additional network cabling to implement the communication links. Another possible network would make use of existing power and grounding in the building. Techniques available today modulate digital information onto high frequency carriers using the power distribution system as the communication medium. The high frequency signals are low amplitude and at a frequency above the 60 Hz power frequency making the high frequency signals easily detectable. Transmission of these high frequency signals has no effect on equipment connected to the power distribution system.

Figure 4:
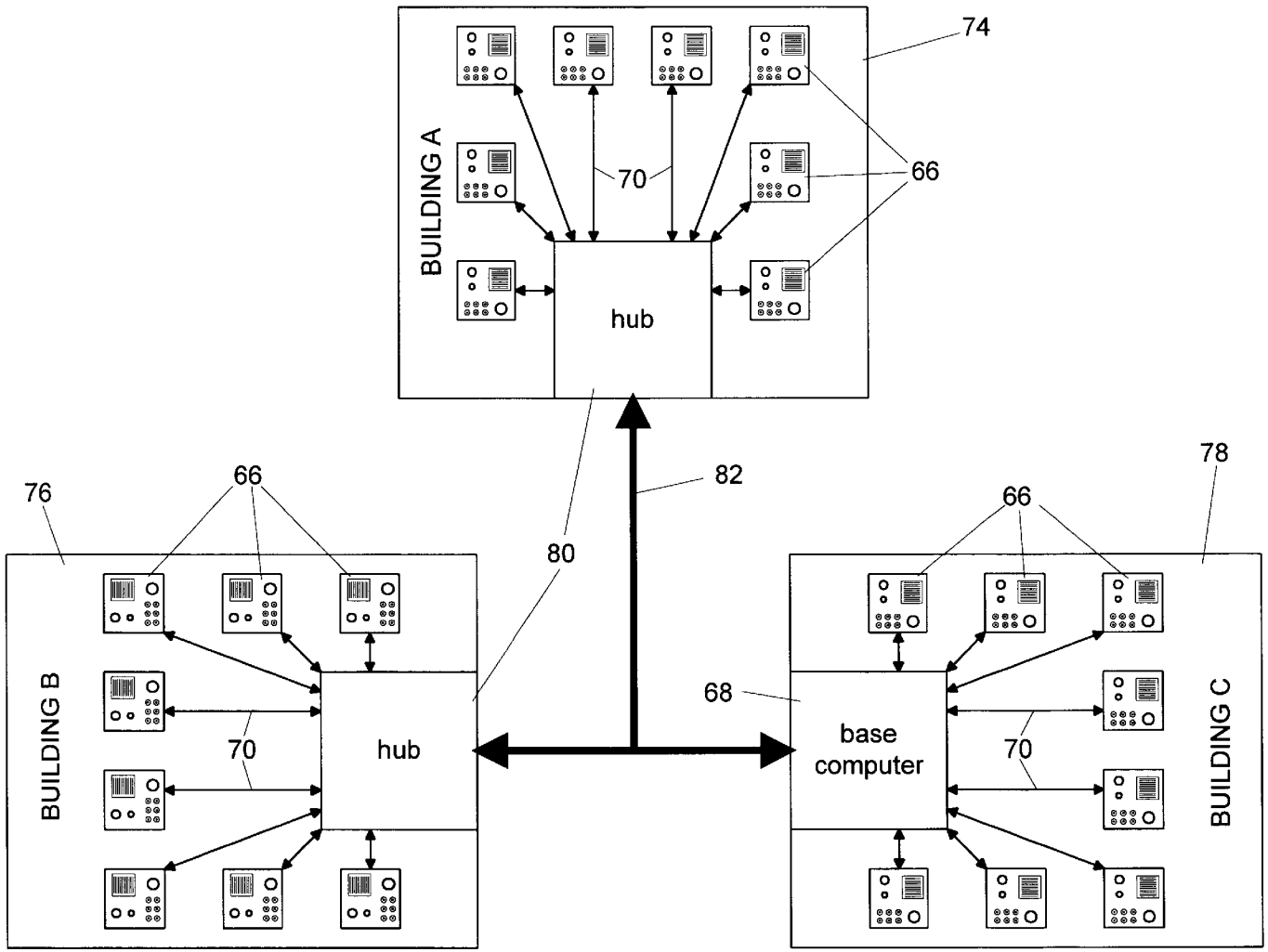
FIG. 4 is a block diagram of a multiple building system employing one base computer.

Another embodiment of the invention uses a single base computer for two or more buildings. This type of implementation would be useful in an organization that has two or more buildings in the same vicinity, such as a university campus. FIG. 4 shows this configuration with three buildings but the concept could be extended to many buildings. In the configuration of FIG. 4 buildings A 74, B 76, and C 78 are configured with many sensor units such as described in FIG. 3 for a single building. However, this scheme uses one base computer 68 located in building C 78. Buildings A 74 and B 76 have hubs, each similar hub shown as 80, to handle communications with the sensor units 66 in those buildings. The hubs 80 also coordinate communications with the base computer 68 using communication link 82. Again, the type of link is not critical to the concept of this invention. With the performance of currently available networks and computer processing, a single base computer can process information from many sensor units.

Figure 5:
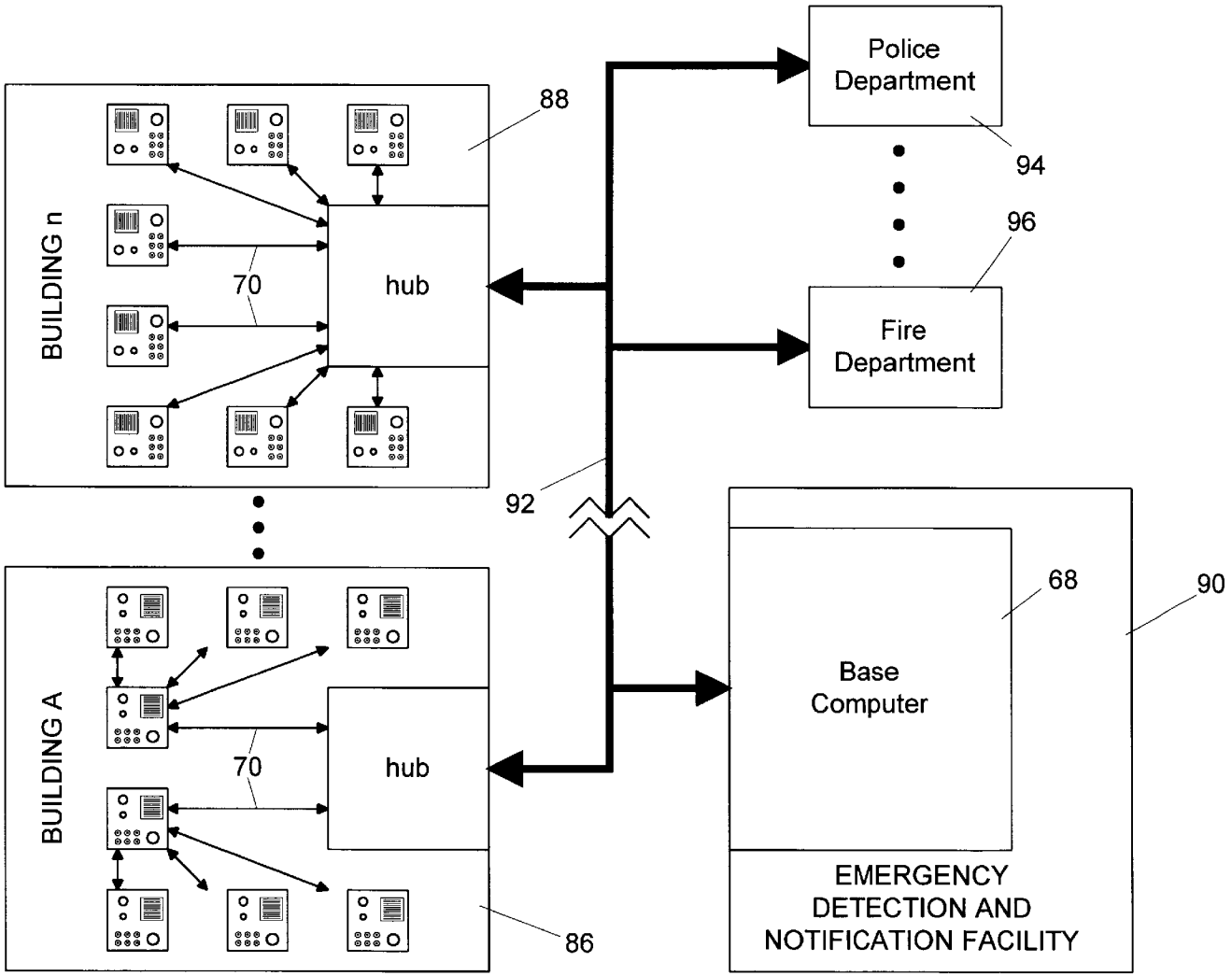
FIG. 5 is a block diagram of a wide area network implementation of the present invention.

In another embodiment, the base computer is located in a facility dedicated to this function. In this scheme many buildings equipped with sensor units, such as 66, of the current invention will communicate with this dedicated facility. FIG. 5 shows two of many possible monitored buildings and are designated building A 86 through building n 88. Each of the many buildings are connected to the emergency detection and notification facility 90 through one or more communication links 92. The type of media used for communication is unimportant to this invention other than it must be reliable and capable of functioning in the adverse conditions that may be experienced during an emergency situation. Once the emergency condition has been identified, the base computer or personnel in the facility will notify the proper emergency personnel such as the police department 94 or fire department 96. Communication to emergency personnel uses the same links 92 used by the sensor unit/base computer communications or may have a dedicated link to provide a reliable connection between base computer and emergency personnel under extreme conditions such as a major earthquake.

The embodiment described in FIG. 5 may be integrated into existing emergency handling systems such as the nationally used 911 emergency system. Integration into the existing 911 system minimizes installation of communication hardware for the current invention as it would make use of hardware already in place. For example, the 911 system implements communications using existing wide spread telephone networks, as well as radio communication links to emergency personnel.

Data from the sensor units is collected during a specific interval or frame time. The frame time is primarily determined by the number of sensor units connected to the system. The speed of the communication media also has a direct impact on the frame time. Sensor units with a higher speed connection to the base computer may have a shorter frame time for a given data rate from a number of similarly configured sensor units. High-speed internet connections, such as DSL and cable, are readily available today providing the required bandwidth for implementation of numerous buildings with many sensor units into the current invention.

The data from the sensor units is collected by the base computer and entered into an expert system knowledge base for determination of the current status of the buildings being monitored by the system. The expert system processes the data to determine if a hazardous condition has developed in the particular building. Initial checks by the expert system determine if sensor readings have crossed threshold settings indicating a danger exists. Threshold levels are determined by medical personnel or other experts with a knowledge of established safe levels for the different possible dangers. If a danger is indicated by a threshold being crossed, the danger must be validated. Danger validation is accomplished by reviewing other sensor readings in the knowledge base and/or direct communication with the facility.

Figure 6:
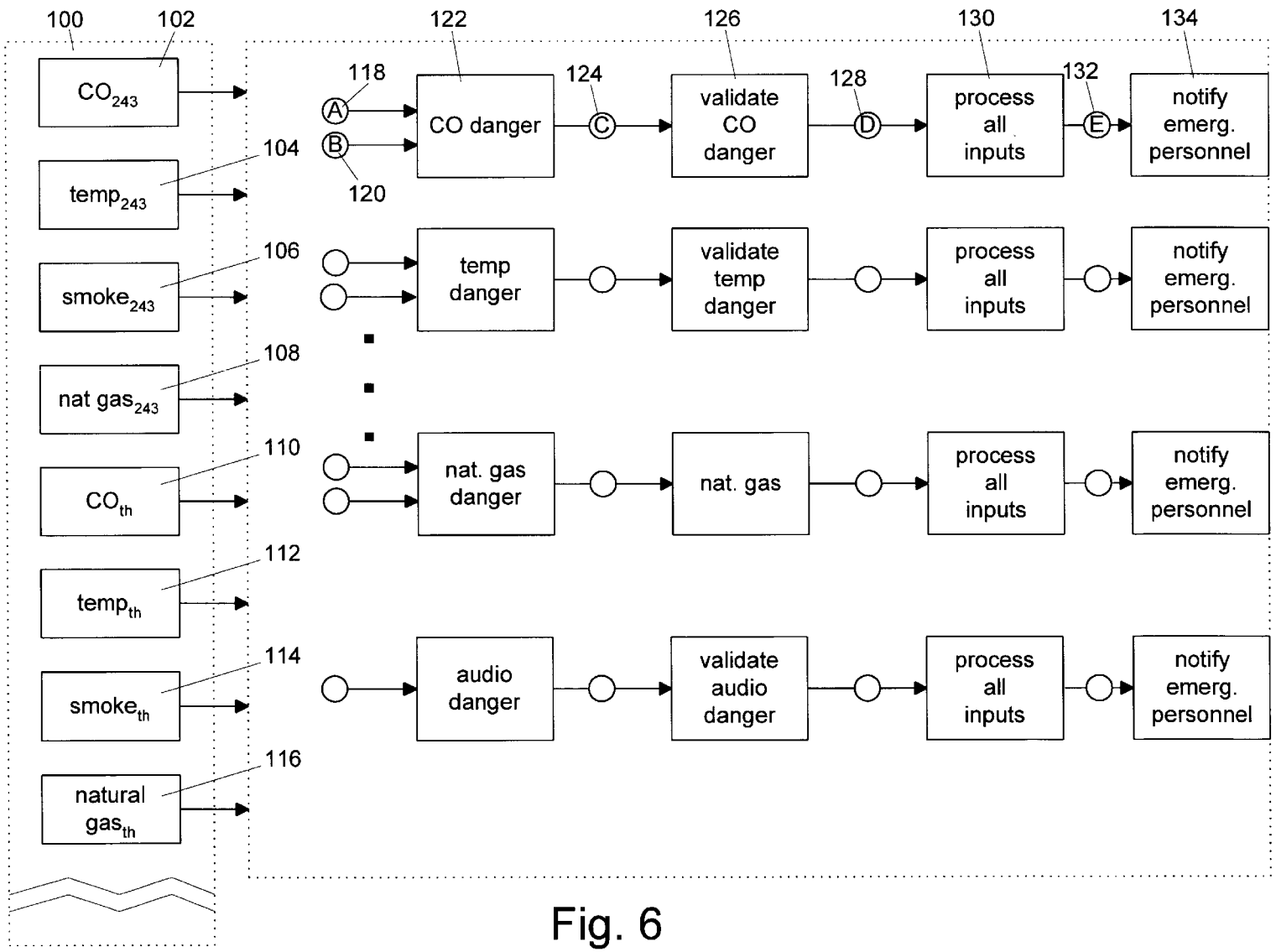
FIG. 6 shows a block diagram of expert system implementing danger detection.

FIG. 6 is a block diagram of the portion of the expert system implementing threshold detection and danger validation. Shown in the knowledge base 100 of the expert system are the sensor inputs for room 243 in a particular building. Room two forty three is a randomly chosen, representative, example site used in this explanation. The threshold values are predetermined by an expert or expert panel with knowledge of what levels of hazardous situations pose a danger to inhabitants. The particular inputs shown in the knowledge base 100 are carbon monoxide (CO) 102, temperature 104, smoke 106, and natural gas 108. Also shown are the threshold values 110–116 for the shown sensor inputs. These sensor inputs and threshold values are only representative of possible inputs and the values are not meant to be an exhaustive list.

The inputs A (118) and B (120) to the expert system are the room 243 sensor reading 102 and threshold value 110 for CO respectively. Determining if a CO danger 122 exists is simply a matter of determining if the sensor reading 118 is larger than the threshold value 120. If a CO danger is believed to exist, value C (124) becomes true and initiates the validation process 126. Other sensor readings indicating a hazardous condition can be the necessary validation. For example, if the temperature sensor and/or the smoke sensor readings were high for room 243, this would indicate a valid hazardous condition for that room. Another form of validation could be a telephone call to the facility to inquire about any abnormal conditions existing at the facility.

After validation of the danger, the expert system will set value D (128) "true" and initiate processing of all inputs 130 for the building to determine as much about the status of each area in the facility as possible. After processing all inputs for the building, value E (132) becomes "true," initiating notification of emergency personnel 134. Processing of all inputs before notification of emergency personnel provides crucial information in preparing for the hazards that may exist and help providing assistance to people in the building. Other inputs may also indicate that a false hazardous condition has been sensed and reported and in actuality no danger currently exists.

Figure 7:
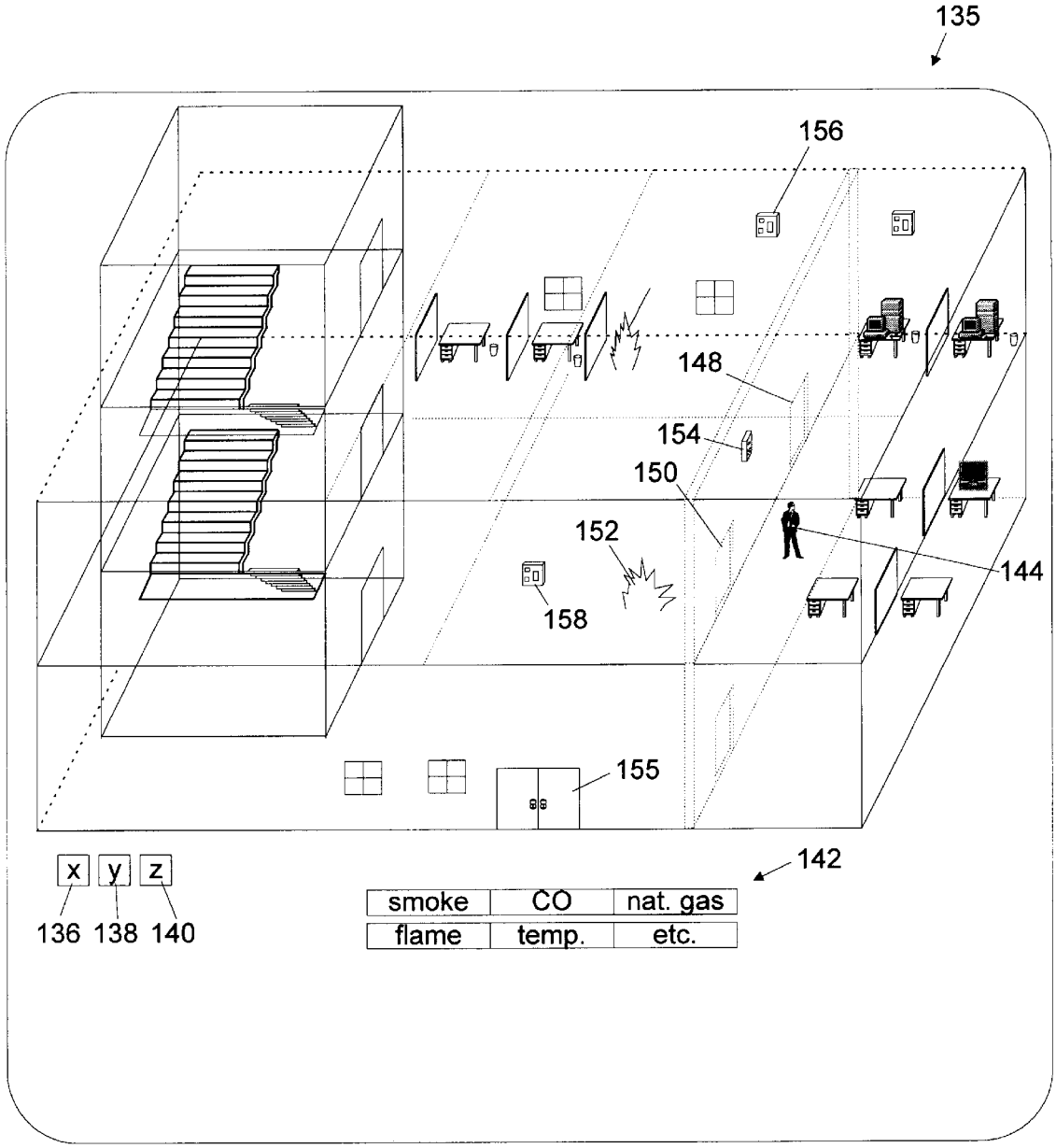
FIG. 7 shows a possible screen of information demonstrating capabilities of a three-dimensional display system.

Once the hazardous situation has been established and emergency personnel have responded, the system may assist the emergency personnel in rescuing persons from the building. In the presence of fire, smoke, confusion, etc., people in the building may not know the best escape route. A three dimensional layout of the building, generally 135 as seen in FIG. 7 may be used to assist in planning escape routes. Emergency personnel using a computer designed to receive information from the base unit can request the three-dimensional image for the building currently experiencing a hazardous situation. Information from the sensor units can be presented on a monitor by selecting the sensor unit using a selecting device such as a mouse, trackball, touch pad, keypad, etc. Computer vision algorithms running on the base computer can determine the location of flames, people, etc. and display them at the proper place on the screen. The three-dimensional image can be rotated to any angle by selecting the proper function on the screen. For instance, software buttons on the screen labeled x 136, y 138, and z 140 can be selected to rotate the image in the desired coordinate direction. Buttons on the screen generally 142 can also be selected to add or remove specific types of information from the screen, with on and off functions toggling with each instance of hitting the button. The ability to toggle information types on and off reduces possible confusion from screen clutter.

The three-dimensional image and sensor information allows emergency personnel to locate and direct people out of the building. For example, in FIG. 7 a person 144 is heading for a doorway 150 to escape a burning building. Emergency personnel operating the 3-D display have detected this person by using the cameras on the sensor units and may give instructions to the person by selecting the speaker on the closest sensor unit to the person with the pointing device. An instruction might be: "person in room 240 exit at the closest door behind you," 148 "fire is blocking the door in front of you" 150. Many other types of instructions may be given to persons, assisting their exit from the burning building. A person may be instructed to climb stairs to the roof of the building due to fire, or other obstructions, at lower levels. Someone else may be instructed to go to a particular window where a ladder can be used to take him or her to safety. For a large building with many floors, rooms, or possible exit routes, expert system algorithms can more rapidly analyze the data from the sensor units and make recommendations for exit routes.

Figure 8:
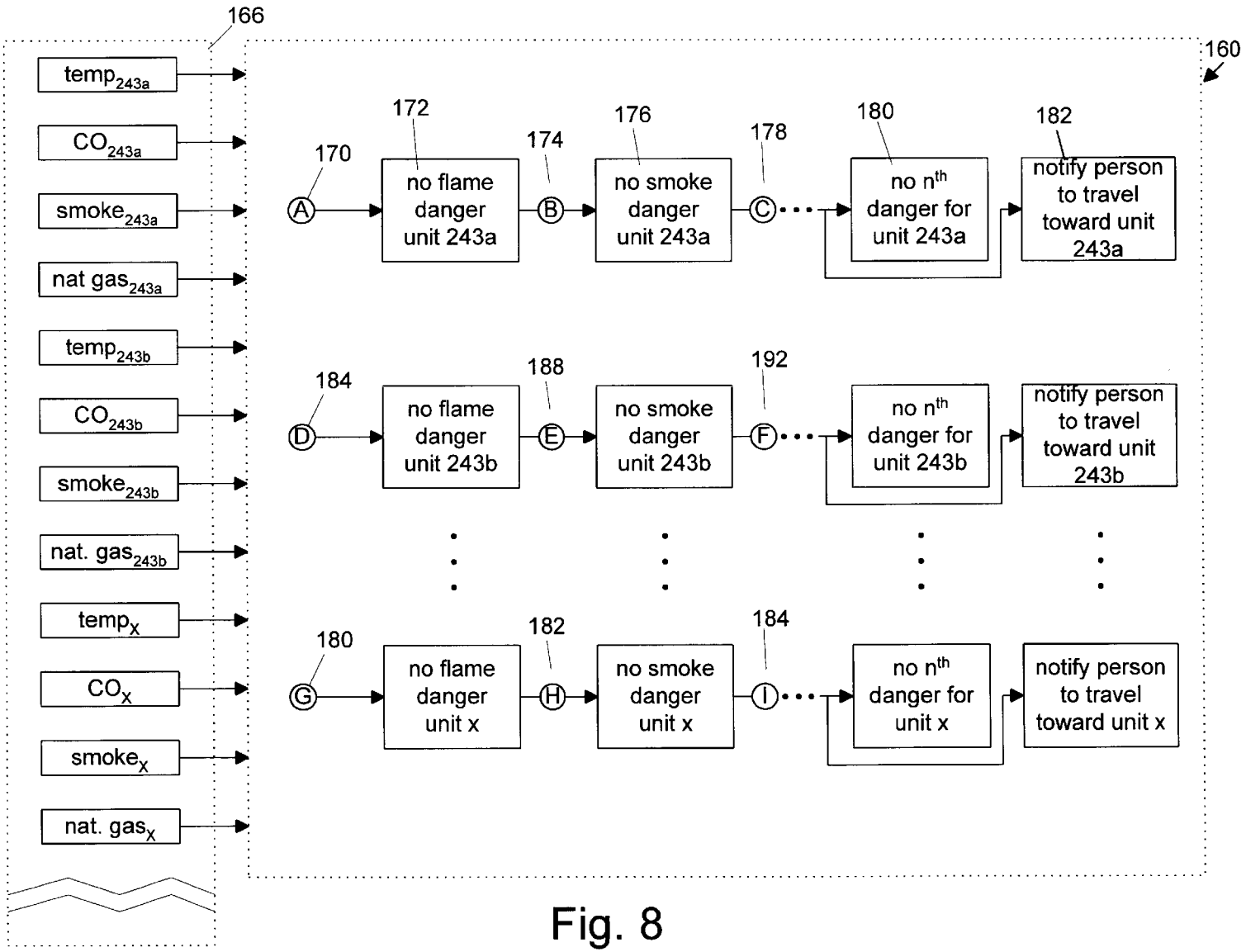
FIG. 8 is a block diagram showing use of the expert system for best escape route determination.

FIG. 8 is a block diagram 160 demonstrating how an expert system can help guide a person in a burning building to safety. The expert system can rapidly analyze current conditions in a room where a person is and the condition of adjacent rooms. Referring to FIG. 7, the person 144 who is trying to get out of the burning building is heading towards flames 152 that will block the route. The person is currently moving near one of the second floor sensors 154 and is trying to get to door 155. Multiple sensors may exist in a single room to provide adequate coverage. In the following example a room number with a letter designates a particular sensor in a room having multiple sensors.

Doorways, windows, stairways, etc. can provide possible escape for person 144 (FIG. 7). Sensors "two forty three a" and "two forty three b", respectively 156 and 158 in FIG. 8, provide information about the two possible doorway exits 148 and 150 of room two forty three. Data from these sensors can be seen in the knowledge base 166 of expert system block diagram 160 in FIG. 8. The expert system algorithm looks for an area adjacent to the current location with all sensor unit readings below danger threshold values. The rules to be considered for the expert system can be seen in the following.

A) IF $flame_{243a}$<$flame_{th}$ THEN no flame $danger_{243a}$

B) IF $smoke_{243a}$<$smoke_{th}$ THEN no smoke $danger_{243a}$

C) IF $n^{th}{}_{243a}$<$n^{th}{}_{th}$ THEN no $n^{th}$ $danger_{243a}$
AND notify person to travel toward sensor unit 243*a*

D) IF $flame_{243b}$<$flame_{th}$ THEN no flame $danger_{243b}$

E) IF $smoke_{243b}$<$smoke_{th}$ THEN no smoke $danger_{243b}$

F) IF $n^{th}{}_{243b}$<$n^{th}{}_{th}$ THEN no $n^{th}$ $danger_{243b}$
AND notify person to travel toward sensor unit 243*b*

G) IF $flame_x$<$flame_{th}$ THEN no flame $danger_x$

H) IF $smoke_x$<$smoke_{th}$ THEN no smoke $danger_x$

I) IF $n^{th}{}_x$<$n^{th}{}_{th}$ THEN no $n^{th}$ $danger_x$
AND notify person to travel toward sensor unit x In FIG. 8 the letters in circles represent a rule that must be considered. If the rule fires (conditions are true) then the box following the rule becomes valid knowledge base information that can be used when evaluating subsequent rules. For the current example of trying to help a person get out of a burning building, rule A (170) looks to see if the flame detection function has identified flames in the area of sensor 243*a* and is stated as: 1) IF $flame_{243a}$<$flame_{th}$ THEN no flame $danger_{243a}$. $Flame_{th}$ is the threshold level for identifying a danger associated with flames in the area. If rule A (170) fires we can consider rule B (174). Since there is no danger from flames, rule B looks to see if any danger exists from smoke in the area of sensor unit two forty three A. This process continues until a danger is seen to exist in the area of sensor unit "two forty three a" or no danger is found. Rule C (178) is the check for the last possible danger in the area of sensor unit "two forty three a". If it fires (i.e. no danger found), then the proper information in the knowledge base is updated and the person is instructed to travel in the direction of sensor unit "two forty three a". Instructions for travel are given in terms the person can relate to, such as, "move to the north doorway heading into room two forty three."

If a rule fails to fire, then consideration of rules moves to the next entry point into the algorithm that evaluates the status of the area around sensor unit "two forty three b", which is also in room two forty three. Rules D, E, and F (184, 188, and 192) are identical to rules A, B, and C (170, 174, and 178) except the data is from sensor unit "two forty three b". If no danger is found in the area of sensor unit "two forty three b" the person will be instructed to move to that area with instructions that relate to known travel routes in the building.

Figure 9:
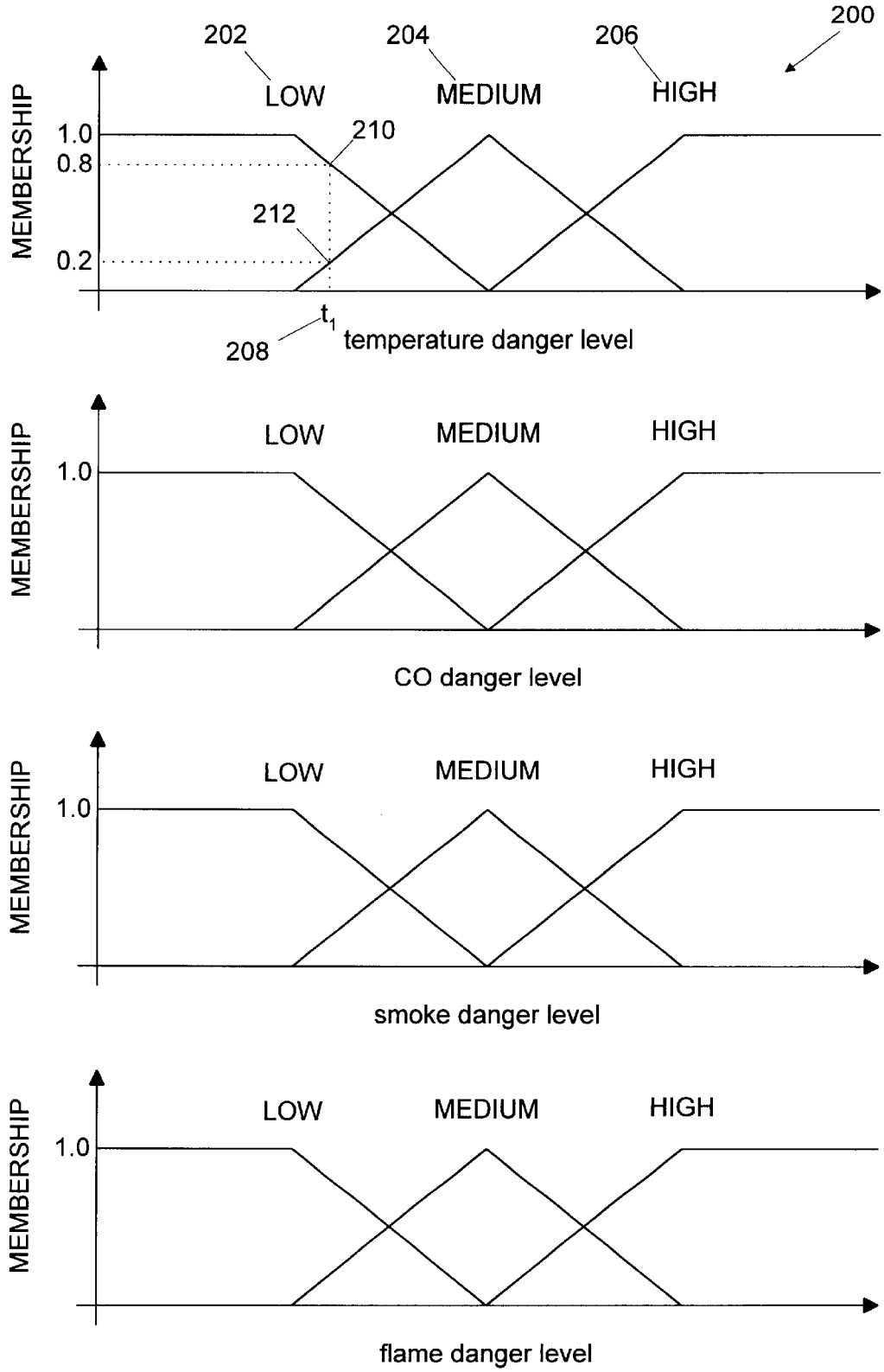
FIG. 9 demonstrates possible membership functions for fuzzy logic calculations.

This process is repeated for all sensor units on the particular floor, or the entire building, allowing possible escape routes to be identified. Rules G, H, and I (180, 182, and 184) demonstrated in FIGS. 8 and 9 show the procession of the algorithm through the last sensor unit. Safe areas around sensor units can be identified on the display of FIG. 7 using some unique coloring scheme, or other technique. One simple color scheme uses green, yellow, and red lights with meaning similar to a traffic control signal. A green light identifying a safe area, yellow indicating some danger, and red signifying an area that should be avoided. With the 3-D display showing areas free of danger (green lights), possible escape routes can be quickly identified by emergency personnel and passed onto persons in the building.

The expert system example of FIG. 8 assumes there is an escape route that is completely free of danger. This may exist and should be checked initially but if no danger free route is found a more sophisticated method for determining the best escape route must be implemented. Using fuzzy logic to place a value on possible escape routes is the method used herein to determine building exit strategies. Fuzzy logic allows ranges of values for parameters involved with a hazardous situation in a building. Fuzzy logic allows varying membership in ranges of values for more flexibility in defining variables such as hot or danger level.

The first step in using fuzzy logic for decision-making is the fuzzification process. During fuzzification crisp input values are converted to fuzzy variables using membership functions. FIG. 9 demonstrates possible membership functions that can be used for the fuzzification of input variables. These are only representative of possible input values and should not be considered an exhaustive list. These membership functions represent the danger levels associated with the various hazards that may exist during a building fire. Other input membership functions may be necessary for other types of hazardous situations.

As an example of the fuzzification process, the membership function for temperature danger level 200 shows ranges of low 202, medium 204, and high 206. These ranges correlate to the length of time a human may survive at that temperature. A human will survive a longer period of time when an area is in the low temperature range as compared to the medium or high temperature range. Instead of qualifying that any temperature above some fixed value is a danger to humans, the danger level is now given membership in low, medium, or high danger levels. A temperature $T_1$ (208) is shown on the temperature danger level membership function 200 of FIG. 9. This temperature is seen to have membership in both the low and medium temperature ranges. $T_1$ has membership 0.8 (210) in the low range and 0.2 (212) in the medium range. This process is continued until all inputs from the sensor units have been fuzzified.

Using the fuzzified inputs, the inference process may evaluate the rules defined by an expert or expert panel knowledgeable in the area of human survivability in extreme conditions. To demonstrate the inference process, FIG. 10 shows inference rules involving CO and smoke using temperature ranges of low 220, medium 222, and high 224. Using these input ranges (low, medium, high) from the fuzzification process for temperature, CO, and smoke danger levels, it is determined which rules have fired. After evaluation of all rules that have fired, a crisp value of the total danger level index associated with an area is determined in the defuzzification process. This danger level index can now be compared to the indices' for other areas allowing the best escape route to be chosen and communicated to a person in the building.

A numerical example can demonstrate the fuzzy logic process. In this example only temperature, CO level, and smoke level are to be considered, with the following arbitrary tabulated values from the fuzzification process.

| Input | fuzzy values | |
|---|---|---|
| Temperature danger Level | .8 low | .2 med |
| CO danger level | 0.65 med | 0.35 high |
| smoke danger level | 0.28 low | 0.72 med |

Figure 11A:
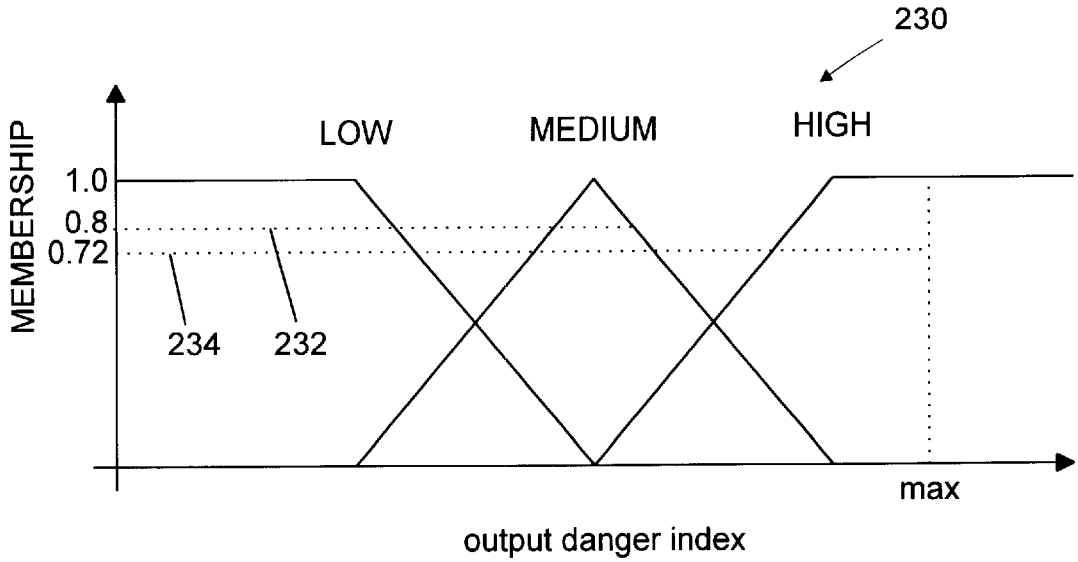
FIG. 11*a* shows a possible membership function for the output danger index.
Figure 11B:
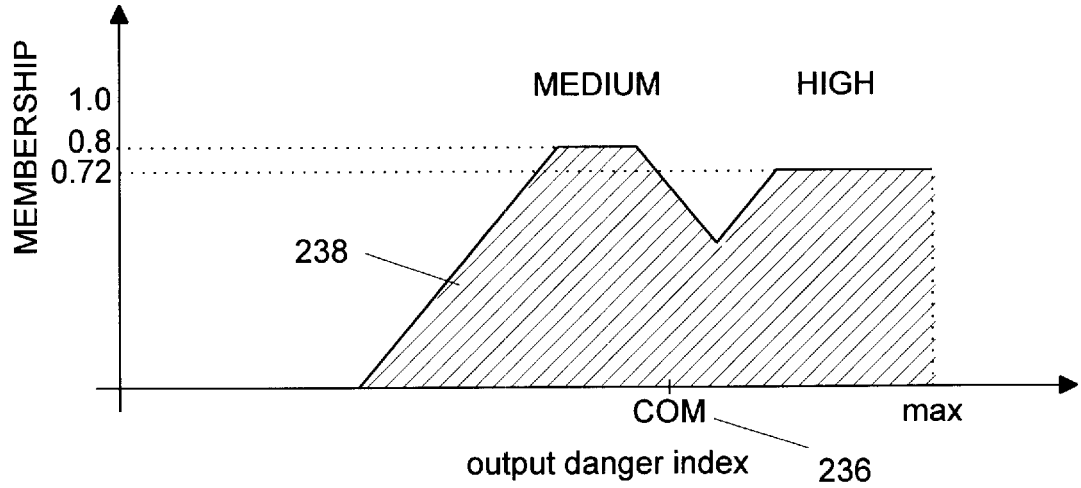
FIG. 11*b* shows calculation of a crisp output value using the center of mass.

These fuzzy values would have been derived from membership functions just as $T_1$ (208) was fuzzified from FIG. 9. From FIG. 10 we can write the inference rules that have fired using the danger index tables for temperature low 220 and medium 222. The two rules that have fired are:

1) IF temperature=low AND CO danger level=medium AND smoke danger level=low THEN output danger index=medium
2) IF temperature=medium AND CO danger level=high AND smoke danger level=medium THEN output danger index=high After rule evaluation a crisp output value is determined from the defuzzication process. FIGS. 11*a* and 11*b* demonstrate the defuzzification process for the two rules of this example. Most cases would involve more rule firings than shown in this example. FIG. 11*a* is the membership function for the output variable of danger index 230 associated with the area around one sensor unit. The maximum output fuzzy values of 0.8 medium 232 and 0.72 high 234 are cutoff values for the triangular membership functions. FIG. 11*b* illustrates how to find the crisp output value of danger index by finding the center of mass (COM) 236 of the enclosed area 238 defined by the triangular membership functions and the cutoff values found from the inference process. Other possible defuzzification algorithms are possible.

Figure 12:
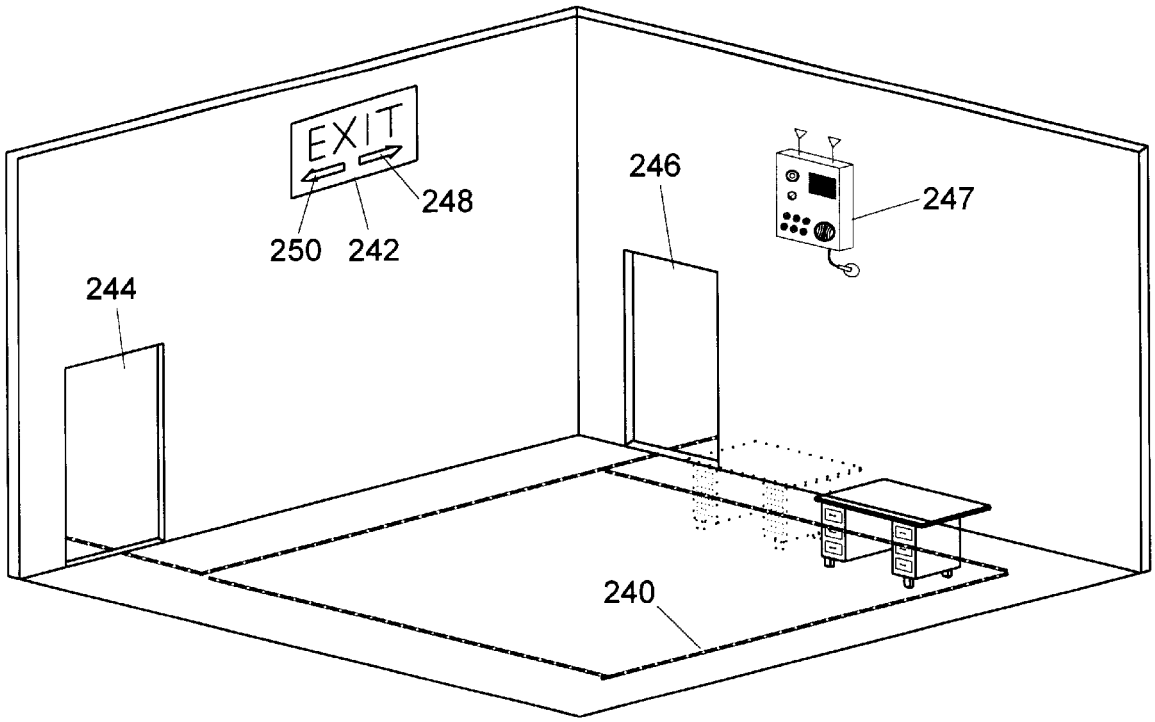
FIG. 12 demonstrates the use of directional lighting and exit signs for escape route determination.

Visibility during emergency situations can be severely impaired by smoke, dust, darkness, and other conditions. This invention implements several types of exit markings to assist persons in taking the best escape route. These exit markings may provide visual cues to supplement voice/audio instructions or may be used alone to provide escape directions if the voice/audio function cannot be heard. FIG. 12 demonstrates two possible types of exit markings, floor lighting 240 and exit signs 242.

The floor lighting of this invention is similar to that found on commercial airlines to assist passengers escaping an aircraft with poor visibility inside. The lighting is comprised of tubes with evenly spaced lights and connectors at each end to connect additional lengths of lighting or connect to the light controlling hardware. Once the expert system has determined the best escape route from an area, the floor lighting will begin to sequence the lights in the direction of the best route for escaping the building. FIG. 12 shows how placement of the floor lighting would assist a person in this room find one of the exit doors 244 or 246. Determination of which door to use is made from data delivered to the base unit by the sensor unit 247 in this room and other sensors proximate to this local sensor nearby.

The exit sign 242 provides similar information as the floor lighting except that is can be viewed at a higher level. This sign serves as the standard (non-emergency) exit marking as well as an emergency device for this invention. Under normal use the exit sign merely directs people in the building to exits 244 or 246. Under abnormal conditions the exit sign flashes the proper directional arrow, right directing arrow 248 or left directing arrow 250 to indicate the proper exit doorway 244 or 246 respectively. Using the exit sign and floor lighting allows for redundancy of visual escape cues.

Figure 13:
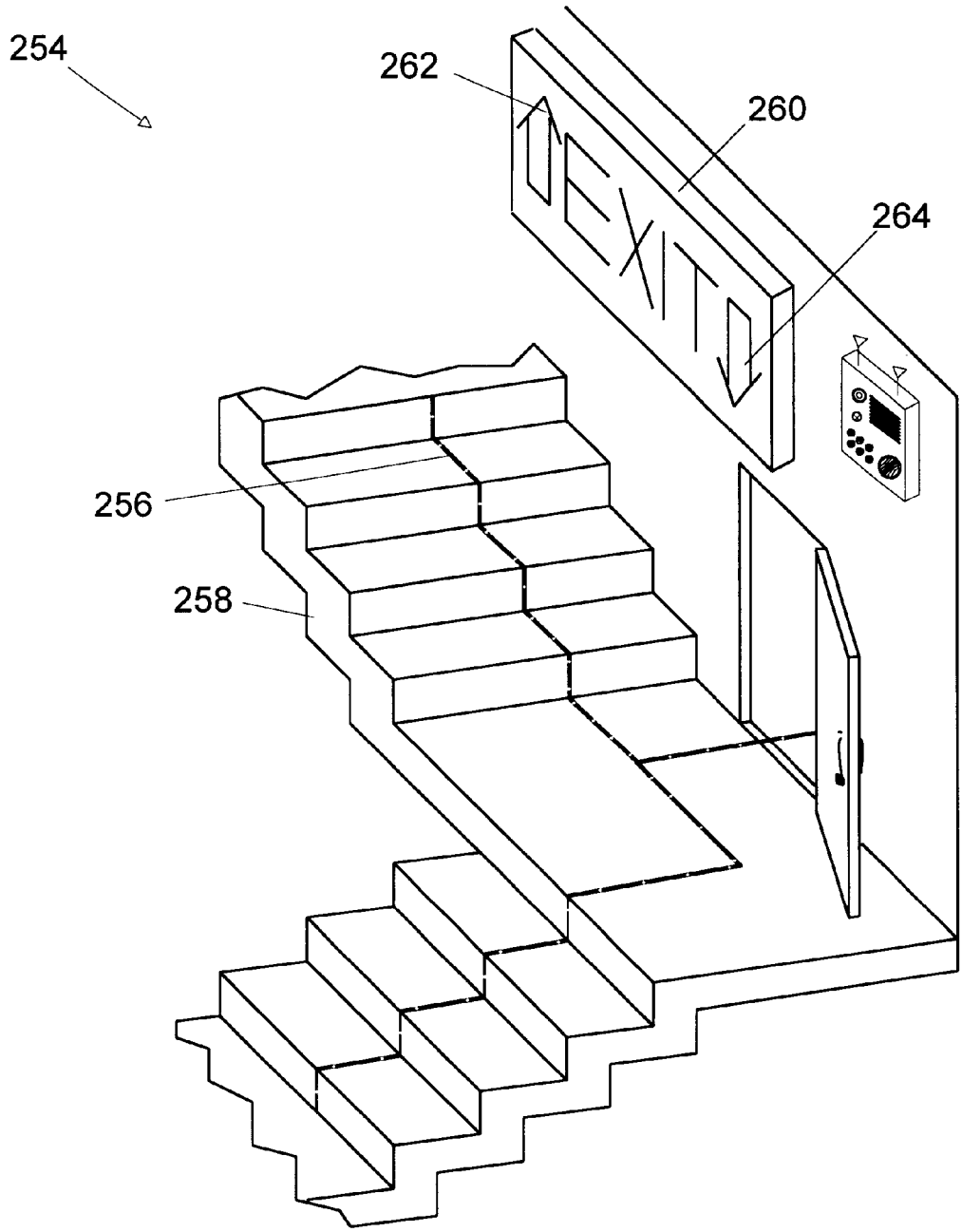
FIG. 13 shows directional lighting and exit signs for use in a stairwell.

Another location for floor directional lighting and exit signs is in stairwells. The function is the same as described for FIG. 12 except direction indicating signs have the added capability of directing people up and down. FIG. 13 shows a typical stairwell 254 employing floor directional lightning 256 on stairs 258. The floor lighting now directs a person to go up or down to escape dangerous conditions in the building. Going up the stairs may be as valid a direction to escape dangerous hazards as going down. Getting to the roof or other upper floor may provide the best escape route. The exit sign 260 has lighted directional arrows that will flash for instructions guiding a person to head up 262 or down 264 the stairs.

Fixed sensor units may be damaged or otherwise incapable of providing the ability to help a person in a building escape hazardous conditions that may exist. Another form of the sensor unit is portable and carried with persons trying to escape danger in a building. The portable units are stored in desks or cabinets clearly marked in areas occupied by workers in a building. When a hazard becomes apparent, persons in the building may use the portable sensor units and respond to received directions.

Figure 14:
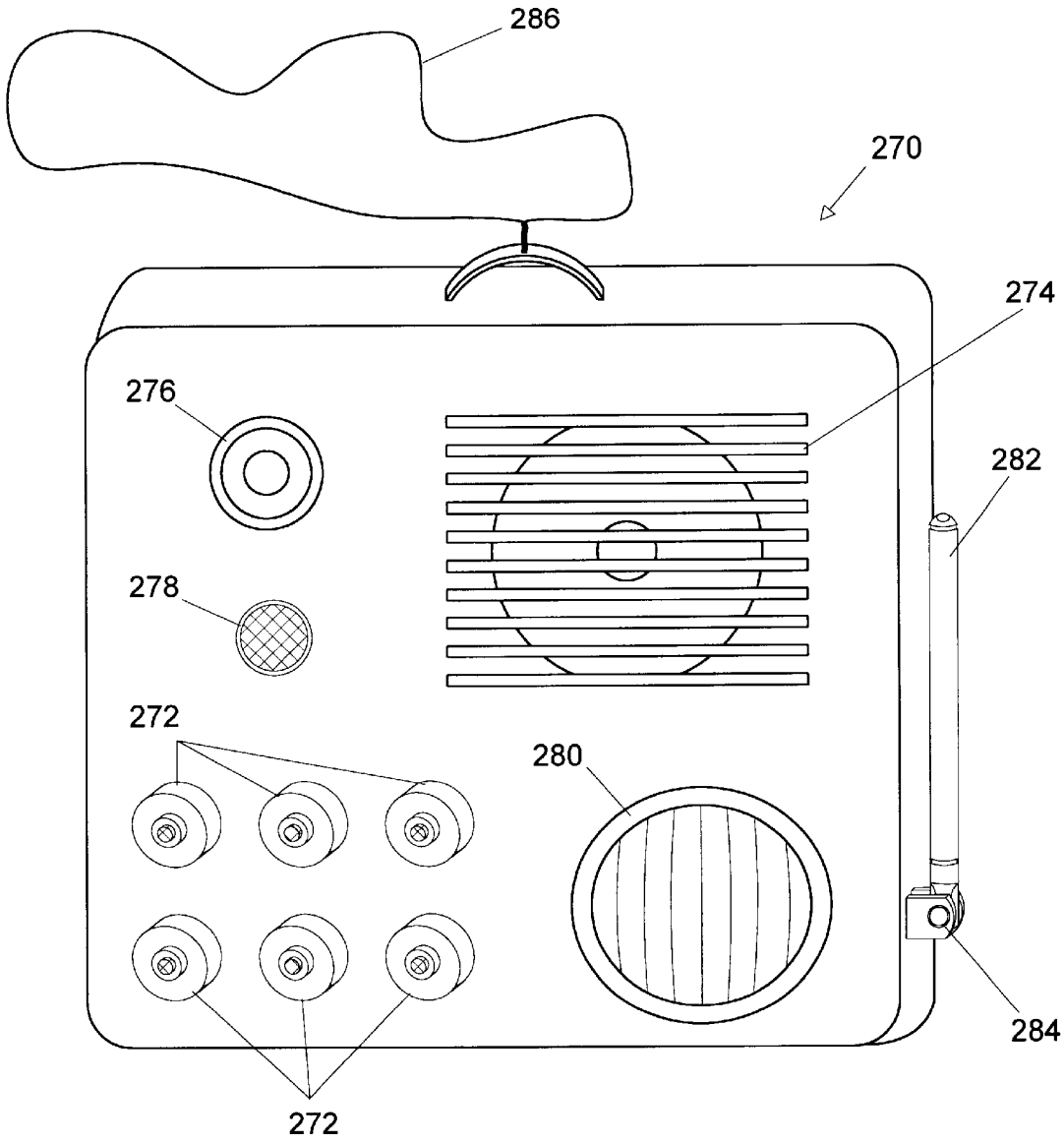
FIG. 14 shows the layout of a portable sensor unit.

FIG. 14 shows one possible design for the portable sensor unit 270. The unit has some or all of the features of the fixed sensor unit, including sensors 272, speaker 274, camera 276, microphone 278, and lighting 280. The portable sensor unit 270 has an antenna 282 that is designed for proper operation with different orientations of the unit. The antenna may be rotated at a pivot point 284 and extended to provide improved communications. The portable unit has means to attach the unit to the person such as a loop 286, allowing the portable sensor unit to be worn around the neck, freeing both hands for other activities that may arise in exiting the building.

The portable unit 270 of FIG. 14 also has a GPS positioning capability similar to the fixed type of unit. The portable unit is constantly transmitting its new position as it moves with a person through the building. This capability allows emergency personnel to monitor the exact location of a person in relation to known dangers that exist in the building. Position of persons carrying the portable sensor units can be displayed on the 3-D display system demonstrated in FIG. 7. Emergency personnel operating the 3-D display and knowing the exact positions of persons in the building can communicate optimum directions for escape, for individual building occupants.

Figure 15:
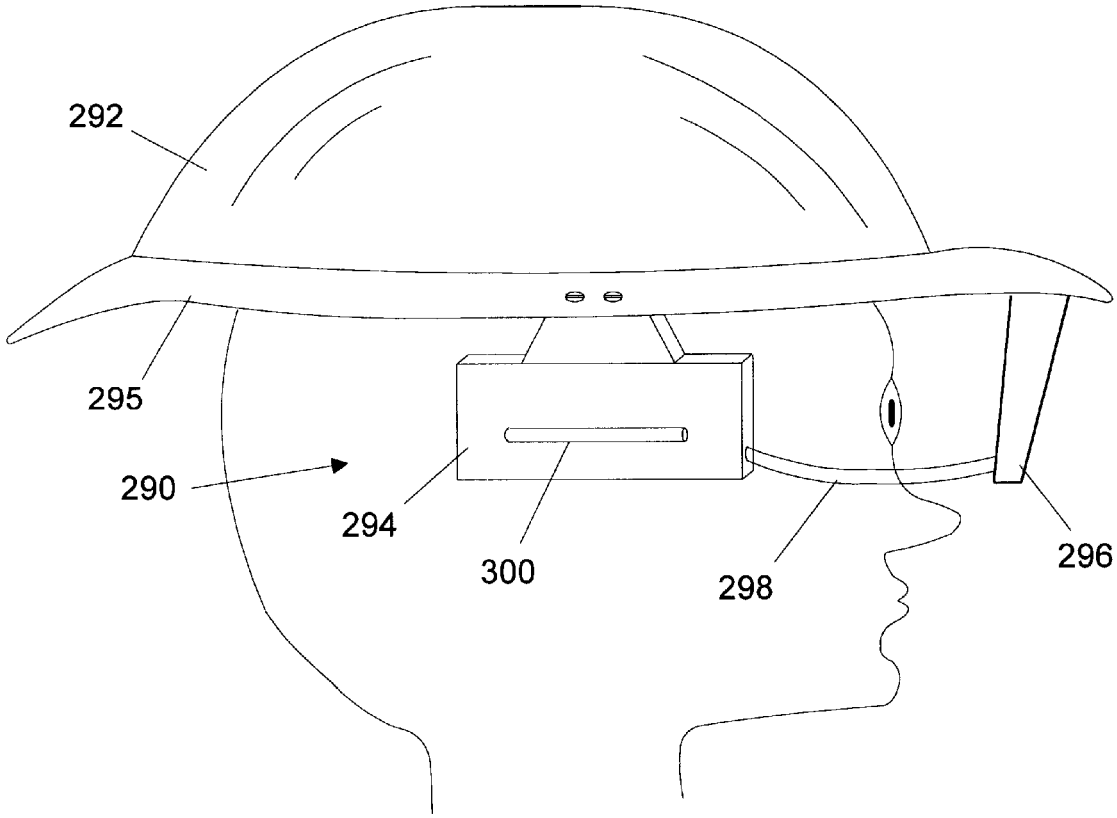
FIG. 15 demonstrates the use of a helmet mounted display for use by emergency personnel.

Emergency personnel entering a building may suffer from lack of visibility due to smoke, dust, etc. This invention implements a helmet mounted display to aid the emergency personnel in rescuing persons in the building. FIG. 15 illustrates a helmet mounted display generally 290 attached to the helmet 292 of a person that will aid the rescue efforts inside the building. The camera unit 294 is attached to the rim 295 of the helmet 292. The video signal is projected onto the display window 296 via the video connection 298. The video connection can take different forms, such as fiber optic, but its form is not important to the invention. An antenna 300 is attached to the camera unit 294 to allow receiving of updated information from the base unit. Current information is critical to properly aid the emergency personnel wearing the helmet mounted display.

The type of information being displayed varies with the particular situation that the rescuer faces. In a fire, the emergency person may want the specific location of flames that exist in the building. In situations where smoke prevents visually choosing a path from the building, the helmet mounted display 290 shows the safest route from the building. If people are trapped in the building the display can show a floor plan and the location of the trapped persons. One method for selecting different information is to use a microphone for voice commands. Words from the emergency person may be processed through speech recognition algorithms. For example, the rescuer may say "persons" and the unit will display the floor plan and location of persons still in the building.

Speech commands from the emergency personnel are broadcast to the base computer and digitized for processing. The digital command may be processed by the base computer for use in determining the proper information to be sent to the helmet display. The information received by the helmet display is then put into the required format for display.

The helmet mounted display concept is equally effective for people in the building as well as the emergency personnel themselves. A less complex version of the helmet mount display available to people in a building will allow for guiding of an individual person or a group of people through a structure experiencing limited visibility. The less complex version would not require all of the functions required by emergency personnel.

The inventions set forth above are subject to many modifications and changes without departing from the spirit, scope or essential characteristics thereof. Thus, the embodiments explained above should be considered in all respect as being illustrative rather than restrictive of the scope of the inventions as defined in the appended claims. For example, the present invention is not limited to the specific embodiments, apparatuses and methods disclosed for only emergency systems in a structure. For instance, this invention would be usable for monitoring the building to determine the number of people in the building and where they are at a particular time, say waiting for an elevator or in a line of cars waiting to get into or out of a parking structure. The present invention is not limited to any particular form of computer or computer algorithm. It is expected that a range of controllers, from a general-purpose computer to a dedicated computer, can be used as the controller for controlling the retrieval apparatus and related transmitter and sensor interface operations.

In summary, one embodiment of a system for intelligently monitoring, detecting and evaluating hazardous situations as in a structure comprises a sensor unit located in the structure. The sensor unit receives inputs for determining structure status and transmitting outputs. The invention also includes a base station information processor in communication with the sensor unit. The base station information processor is capable of processing information received from sensor unit inputs. Also included is a radio signal positioning system in communication with the sensor unit and an expert system residing on the base station. The expert system processes information related to identification of hazardous situations and preferred routes of ingress and egress of the structure.

What is claimed:

1. A system for intelligently monitoring, detecting, and evaluating hazardous situations comprising:

a. a portable sensor unit, said portable sensor unit for receiving inputs and transmitting outputs;

b. a radio signal positioning system inputting data to said portable sensor unit whereby location information of said portable sensor unit, based on radio signal positioning information received by said portable sensor unit from said radio signal positioning system, is stored in said portable sensor unit; and c. a base station information processor in communication with said portable sensor unit, said base station information processor for processing information received from said portable sensor unit transmission output, said information received by said base station information processor from said portable sensor unit including radio signal positioning information stored in said portable sensor unit;

d. said base station having an expert system, said expert system processing information related to output received from said portable sensor unit, wherein the expert system comprises a computer having a memory containing a plurality of fuzzy inference rules, each rule defining a danger index depending on the combined states of a plurality of variables defining structure status contained in the outputs received from said portable sensor unit, and wherein the computer is structured:

(i) to use received signals defining the sensed variables to select and reproduce from the memory applicable ones of the plurality of rules and to apply the selected rules, using fuzzy logic, to derive an index of danger at various different locations in the structure; and (ii) to compare the danger indices at each of said locations to derive a preferred one of several alternate routes, each route connecting at least one point inside the structure and a point outside the structure.

2. The system of claim 1 wherein said portable sensor unit has the capability of constantly updating said base station information processing system.

3. The system of claim 1 wherein said portable sensor unit allows communication proximate said portable sensor unit.

4. The system of claim 1 wherein communications with said base station information processing unit and said sensors is radio signal communication technology having spread spectrum techniques for multiple transmitter/receiver pairs.

5. The system of claim 4 wherein said spread spectrum technique is code division multiple access.

6. The system of claim 5 wherein said base station information processing system is in communication with "911" emergency systems.

7. A system for detecting and evaluating hazardous situations in a structure and for assisting emergency personnel in rescuing personnel determined to be in a hazardous situation in said structure, said system having a base station information processor including a transceiver for receiving and sending wireless communications, a computing device and input and output devices for inputting and outputting data to and from said computing device, the system comprising:

a. a plurality of stationary sensor units fixedly mounted in the structure, at least one of said sensor units for sensing multiple environmental factors, said environmental factors including indicia of fire, smoke, gas levels, sounds, optical information, and location information of said one of said sensor units, said sensor units for determining status of the structure in the vicinity of each location where said one of said plurality of sensor units is located, said plurality of sensor units further comprising sensor wireless input and output signal broadcast capability for receiving input signals and transmitting output signals from said sensor units;

b. a radio signal positioning system accessible by each of said stationary sensor units for storing the position of said sensor units, said sensor units transmitting their positions to said base station information processor;

c. an expert system, including a fuzzy logic system, said expert system for processing information input to said base station computing device and for outputting information from said base station computing device to each of said sensor units;

d. said input and output device of said computing device in communication with a monitor screen for displaying a three dimensional projection of said building including real time locations of said stationary sensor units and real time data display of environmental factors in the vicinity of each sensor unit; and e. a helmet having a wireless transceiver for transmitting and receiving wireless communications, a helmet mounted display, a helmet mounted camera, and a receiver for receiving signals broadcast by said radio signal positioning system, said transceiver of said helmet sending helmet position information determined from said signal broadcast by said radio signal positioning system to said base station computing device, and said output device of said computing device in communication with said helmet mounted display for displaying structure and environmental factors in the vicinity of said helmet.

8. The system of claim 7 wherein at least one of the plurality of sensor units includes warning output capabilities including a light of various selected colors for various selected situations and light flashing functions to provide visual information in the vicinity proximate said sensor unit.

9. The system of claim 7 wherein said positioning system of each of the sensor units and the helmet receiver receives signals from earth orbiting satellites.

10. The system of claim 7 wherein communications with said base station information processing unit, said sensors, and said helmet is radio signal communication technology having spread spectrum techniques for multiple transmitter/receiver pairs.

11. The system of claim 10 wherein said spread spectrum technique is code division multiple access.

12. The system of claim 7 wherein communication between said sensor units and said base information processor are accomplished via a network of interconnected information processors.

13. The system of claim 7 wherein said base station information processing system is in communication with "911" emergency systems.

14. The system of claim 7 wherein said three-dimensional display system selectively displays information from every sensor unit in a particular structure.

15. The system of claim 14 wherein said three-dimensional display view may be manipulated to show various perspectives.

16. The system of claim 7 wherein said system has directional floor lighting that sequences under control of said base station information processor whereby said floor lighting sequences in the best direction for persons to escape from a particular location and sequences to lead rescue personnel to a target zone in said structure.

17. The system of claim 7 further comprising a. a plurality of transportable sensor units stored in said structure, at least one of said transportable sensor units for sensing multiple environmental factors, said environmental factors including indicia of fire, smoke, gas levels, sounds, optical information, and location information of said one of said transportable sensor units, said sensor units for determining status of the structure in the vicinity of a location where said one of said plurality of transportable sensor units is at any particular time, said plurality of transportable sensor units further comprising transportable sensor output signal broadcast capability for transmitting output signals from said transportable sensor units; and b. said radio signal positioning system accessible by each of said transportable sensor units for storing the position of said transportable sensor units, said transportable sensor units transmitting their positions to said base station information processor.

18. The system of claim 17 wherein said positioning system of each of the sensor units and the helmet receiver receives signals from earth orbiting satellites.

19. The system of claim 17 wherein communications with said base station information processing unit, said sensors, and said helmet is radio signal communication technology having spread spectrum techniques for multiple transmitter/receiver pairs.

20. The system of claim 19 wherein said spread spectrum technique is code division multiple access.

21. A system for intelligently monitoring, detecting, and evaluating hazardous situations in a structure comprising:

a. a plurality of sensor modules, each located at different location in a structure, each sensor module configured to sense a plurality of distinct predetermined variables defining structure status, and each sensor module having at least one wireless transmitter associated therewith;

b. a base station having a radio receiver configured to receive radio signals transmitted from each of the sensor modules; and c. a computer at the base station having access to the signals received from the sensor modules and having a memory containing a plurality of fuzzy inference rules, each rule defining a danger index depending on the combined states of the plurality of variables defining structure status;

d. wherein the computer is structured, for each of the sensor units, to use received signals defining the sensed variables to select and reproduce from the memory applicable ones of the plurality of rules and to apply the selected rules, using fuzzy logic, to derive an index of danger at each of the different locations in the structure; and e. wherein the computer is further structured to compare the danger indices at each of said locations to derive a preferred one of several alternate routes, each route connecting at least one point inside the structure and a point outside the structure.

22. The system of claim 21 further comprising a route-instruction announcement system at various locations within the structure, and wherein the computer is coupled via wireless signal to the route-instruction announcement system and wherein the route-instruction announcement system is responsive to signals defining the preferred route derived by the computer.

23. The system of claim 22 wherein the route-instruction announcement system comprises selectively controllable exit lighting distributed through the structure.

24. The system of claim 22 wherein the route-instruction announcement system comprises a plurality of speakers distributed through the structure and synthesized human-audible audio instructions capable of being played on the speakers.

25. A method of intelligently monitoring, detecting, and evaluating hazardous situations in a structure comprising:

a. sensing, at a plurality of different location in a structure, a plurality of distinct predetermined variables defining structure status;

b. wirelessly transmitting signals defining the sensed variables to a base station;

c. for the signals defining the sensed variables received at the base station from each different location, using the signals to select applicable ones of a plurality of fuzzy inference rules, each rule defining a danger index depending on the combined states of the plurality of variables defining structure status;

d. for the signals defining the sensed variables received at the base station from each different location, automatically applying the selected rules, using fuzzy logic, to derive an index of danger at each of the different locations; and e. automatically comparing the danger indices at each of said locations to derive a preferred one of several alternate routes, each route connecting at least one point inside the structure and a point outside the structure.

26. The method of claim 25 further comprising using the derived preferred route to automatically display within the structure human-perceptible instructions about the preferred route.

27. The method of claim 26 wherein using the derived preferred route comprises wirelessly transmitting data about the preferred route from the base station to various locations within the structure.

28. The method of claim 26 wherein automatically displaying within the structure human-perceptible instructions about the preferred route comprises selectively controlling exit lighting distributed through the structure.

29. The method of claim 28 wherein selectively controlling exit lighting distributed through the structure comprises sequencing floor lighting in the direction of the outside of the structure along the preferred route.

30. The method of claim 26 wherein automatically displaying within the structure human-perceptible instructions about the preferred route comprises playing synthesized human-audible audio instructions on speakers within the structure.

* * * * *

UNITED STATES PATENT AND TRADEMARK OFFICE

CERTIFICATE OF CORRECTION

PATENT NO. : 6,873,256 B2
DATED : March 29, 2005
INVENTOR(S) : Jerome H. Lemelson et al.

It is certified that error appears in the above-identified patent and that said Letters Patent is hereby corrected as shown below:

Title page,
Item [75], Inventors, please add, -- Tracy D. Blake, 14641 North 49th Place, Scottsdale, AZ (US) 85254 --

Signed and Sealed this

Seventh Day of June, 2005

JON W. DUDAS
*Director of the United States Patent and Trademark Office*